US010960681B2

(12) United States Patent
Ho

(10) Patent No.: US 10,960,681 B2
(45) Date of Patent: Mar. 30, 2021

(54) AUTOCORRECTION FOR UNEVEN PRINT PRESSURE ON PRINT MEDIA

(71) Applicant: Datamax-O'Neil Corporation, Altamonte Springs, FL (US)

(72) Inventor: Wai Kit Ho, Singapore (SG)

(73) Assignee: DATAMAX-O'NEIL CORPORATION, Altamonte Springs, FL (US)

( * ) Notice: Subject to any disclaimer, the term of this patent is extended or adjusted under 35 U.S.C. 154(b) by 0 days.

(21) Appl. No.: 16/511,840

(22) Filed: Jul. 15, 2019

(65) Prior Publication Data

US 2019/0337303 A1 Nov. 7, 2019

Related U.S. Application Data

(63) Continuation of application No. 15/696,359, filed on Sep. 6, 2017, now Pat. No. 10,399,359.

(51) Int. Cl.
*B41J 2/36* (2006.01)

(52) U.S. Cl.
CPC ..... *B41J 2/362* (2013.01)

(58) Field of Classification Search
CPC ..... B41J 29/393; B41J 2/32; B41J 2/36; B41J 2/362
See application file for complete search history.

(56) References Cited

U.S. PATENT DOCUMENTS 4,827,279 A 5/1989 Lubinsky et al.
6,832,725 B2 12/2004 Gardiner et al.
7,128,266 B2 10/2006 Zhu et al.
7,159,783 B2 1/2007 Walczyk et al.
7,413,127 B2 8/2008 Ehrhart et al.
(Continued)

FOREIGN PATENT DOCUMENTS

WO 2013/163789 A1 11/2013

OTHER PUBLICATIONS

Notice of Allowance for related U.S. Appl. No. 15/696,359, dated May 20, 2019, 10 pages.
(Continued)

*Primary Examiner* — Jannelle M Lebron
(74) *Attorney, Agent, or Firm* — Alston & Bird LLP

(57) ABSTRACT

A printer may be used to print on print media, such as labels, where the print media, as fed through the print, spans substantially less than the full width of the printhead and platen. This may result in uneven print pressure across the print media during the print process. The uneven print pressure, in turn, may result in an uneven print density on the print media, which causes poor print quality. A system and method is employed with identifies the uneven print pressure, and compensates for the uneven print pressure to ensure consistent print density and good print quality. Along segments of the printhead which apply a below average pressure to the print media, the printhead is configured to apply a proportionately higher density of an appropriate contrast-inducing element, such as ink or heat. Along segments of the printhead which apply an above average pressure to the print media, the printhead is configured to apply a proportionately lower density of an appropriate contrast-inducing element, such as ink or heat.

17 Claims, 5 Drawing Sheets

Exemplary Thermal Printer

(56) References Cited

U.S. PATENT DOCUMENTS 7,726,575 B2 6/2010 Wang et al.
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Horn et al.
8,381,979 B2 2/2013 Franz
8,390,909 B2 3/2013 Plesko
8,408,464 B2 4/2013 Zhu et al.
8,408,468 B2 4/2013 Van et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van et al.
8,556,177 B2 10/2013 Hussey et al.
8,559,767 B2 10/2013 Barber et al.
8,561,895 B2 10/2013 Gomez et al.
8,561,903 B2 10/2013 Sauerwein, Jr.
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre, Jr.
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz, Sr.
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue et al.
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein, Jr.
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.

(56) References Cited

U.S. PATENT DOCUMENTS

| | | | |
|---|---|---|---|
| D723,560 | S | 3/2015 | Zhou et al. |
| 8,967,468 | B2 | 3/2015 | Gomez et al. |
| 8,971,346 | B2 | 3/2015 | Sevier |
| 8,976,030 | B2 | 3/2015 | Cunningham et al. |
| 8,976,368 | B2 | 3/2015 | El et al. |
| 8,978,981 | B2 | 3/2015 | Guan |
| 8,978,983 | B2 | 3/2015 | Bremer et al. |
| 8,978,984 | B2 | 3/2015 | Hennick et al. |
| 8,985,456 | B2 | 3/2015 | Zhu et al. |
| 8,985,457 | B2 | 3/2015 | Soule et al. |
| 8,985,459 | B2 | 3/2015 | Kearney et al. |
| 8,985,461 | B2 | 3/2015 | Gelay et al. |
| 8,988,578 | B2 | 3/2015 | Showering |
| 8,988,590 | B2 | 3/2015 | Gillet et al. |
| 8,991,704 | B2 | 3/2015 | Hopper et al. |
| 8,996,194 | B2 | 3/2015 | Davis et al. |
| 8,996,384 | B2 | 3/2015 | Funyak et al. |
| 8,998,091 | B2 | 4/2015 | Edmonds et al. |
| 9,002,641 | B2 | 4/2015 | Showering |
| 9,007,368 | B2 | 4/2015 | Laffargue et al. |
| 9,010,641 | B2 | 4/2015 | Qu et al. |
| 9,015,513 | B2 | 4/2015 | Murawski et al. |
| 9,016,576 | B2 | 4/2015 | Brady et al. |
| D730,357 | S | 5/2015 | Fitch et al. |
| 9,022,288 | B2 | 5/2015 | Nahill et al. |
| 9,030,964 | B2 | 5/2015 | Essinger et al. |
| 9,033,240 | B2 | 5/2015 | Smith et al. |
| 9,033,242 | B2 | 5/2015 | Gillet et al. |
| 9,036,054 | B2 | 5/2015 | Koziol et al. |
| 9,037,344 | B2 | 5/2015 | Chamberlin |
| 9,038,911 | B2 | 5/2015 | Xian et al. |
| 9,038,915 | B2 | 5/2015 | Smith |
| D730,901 | S | 6/2015 | Oberpriller et al. |
| D730,902 | S | 6/2015 | Fitch et al. |
| 9,047,098 | B2 | 6/2015 | Barten |
| 9,047,359 | B2 | 6/2015 | Caballero et al. |
| 9,047,420 | B2 | 6/2015 | Caballero |
| 9,047,525 | B2 | 6/2015 | Barber et al. |
| 9,047,531 | B2 | 6/2015 | Showering et al. |
| 9,049,640 | B2 | 6/2015 | Wang et al. |
| 9,053,055 | B2 | 6/2015 | Caballero |
| 9,053,378 | B1 | 6/2015 | Hou et al. |
| 9,053,380 | B2 | 6/2015 | Xian et al. |
| 9,057,641 | B2 | 6/2015 | Amundsen et al. |
| 9,058,526 | B2 | 6/2015 | Powilleit |
| 9,061,527 | B2 | 6/2015 | Tobin et al. |
| 9,064,165 | B2 | 6/2015 | Havens et al. |
| 9,064,167 | B2 | 6/2015 | Xian et al. |
| 9,064,168 | B2 | 6/2015 | Todeschini et al. |
| 9,064,254 | B2 | 6/2015 | Todeschini et al. |
| 9,066,032 | B2 | 6/2015 | Wang |
| 9,070,032 | B2 | 6/2015 | Corcoran |
| D734,339 | S | 7/2015 | Zhou et al. |
| D734,751 | S | 7/2015 | Oberpriller et al. |
| 9,076,459 | B2 | 7/2015 | Braho et al. |
| 9,079,423 | B2 | 7/2015 | Bouverie et al. |
| 9,080,856 | B2 | 7/2015 | Laffargue |
| 9,082,023 | B2 | 7/2015 | Feng et al. |
| 9,084,032 | B2 | 7/2015 | Rautiola et al. |
| 9,087,250 | B2 | 7/2015 | Coyle |
| 9,092,681 | B2 | 7/2015 | Havens et al. |
| 9,092,682 | B2 | 7/2015 | Wilz et al. |
| 9,092,683 | B2 | 7/2015 | Koziol et al. |
| 9,093,141 | B2 | 7/2015 | Liu |
| 9,098,763 | B2 | 8/2015 | Lu et al. |
| 9,104,929 | B2 | 8/2015 | Todeschini |
| 9,104,934 | B2 | 8/2015 | Li et al. |
| 9,107,484 | B2 | 8/2015 | Chaney |
| 9,111,159 | B2 | 8/2015 | Liu et al. |
| 9,111,166 | B2 | 8/2015 | Cunningham, IV |
| 9,135,483 | B2 | 9/2015 | Liu et al. |
| 9,137,009 | B1 | 9/2015 | Gardiner |
| 9,141,839 | B2 | 9/2015 | Xian et al. |
| 9,147,096 | B2 | 9/2015 | Wang |
| 9,148,474 | B2 | 9/2015 | Skvoretz |
| 9,158,000 | B2 | 10/2015 | Sauerwein, Jr. |
| 9,158,340 | B2 | 10/2015 | Reed et al. |
| 9,158,953 | B2 | 10/2015 | Gillet et al. |
| 9,159,059 | B2 | 10/2015 | Daddabbo et al. |
| 9,165,174 | B2 | 10/2015 | Huck |
| 9,171,543 | B2 | 10/2015 | Emerick et al. |
| 9,183,425 | B2 | 11/2015 | Wang |
| 9,189,669 | B2 | 11/2015 | Zhu et al. |
| 9,195,844 | B2 | 11/2015 | Todeschini et al. |
| 9,202,458 | B2 | 12/2015 | Braho et al. |
| 9,208,366 | B2 | 12/2015 | Liu |
| 9,208,367 | B2 | 12/2015 | Smith |
| 9,219,836 | B2 | 12/2015 | Bouverie et al. |
| 9,224,022 | B2 | 12/2015 | Ackley et al. |
| 9,224,024 | B2 | 12/2015 | Bremer et al. |
| 9,224,027 | B2 | 12/2015 | Van et al. |
| D747,321 | S | 1/2016 | London et al. |
| 9,230,140 | B1 | 1/2016 | Ackley |
| 9,235,553 | B2 | 1/2016 | Fitch et al. |
| 9,239,950 | B2 | 1/2016 | Fletcher |
| 9,245,492 | B2 | 1/2016 | Ackley et al. |
| 9,248,640 | B2 | 2/2016 | Heng |
| 9,250,652 | B2 | 2/2016 | London et al. |
| 9,250,712 | B1 | 2/2016 | Todeschini |
| 9,251,411 | B2 | 2/2016 | Todeschini |
| 9,258,033 | B2 | 2/2016 | Showering |
| 9,262,633 | B1 | 2/2016 | Todeschini et al. |
| 9,262,660 | B2 | 2/2016 | Lu et al. |
| 9,262,662 | B2 | 2/2016 | Chen et al. |
| 9,269,036 | B2 | 2/2016 | Bremer |
| 9,270,782 | B2 | 2/2016 | Hala et al. |
| 9,274,812 | B2 | 3/2016 | Doren et al. |
| 9,275,388 | B2 | 3/2016 | Havens et al. |
| 9,277,668 | B2 | 3/2016 | Feng et al. |
| 9,280,693 | B2 | 3/2016 | Feng et al. |
| 9,286,496 | B2 | 3/2016 | Smith |
| 9,297,900 | B2 | 3/2016 | Jiang |
| 9,298,964 | B2 | 3/2016 | Li et al. |
| 9,301,427 | B2 | 3/2016 | Feng et al. |
| 9,304,376 | B2 | 4/2016 | Anderson |
| 9,310,609 | B2 | 4/2016 | Rueblinger et al. |
| 9,313,377 | B2 | 4/2016 | Todeschini et al. |
| 9,317,037 | B2 | 4/2016 | Byford et al. |
| D757,009 | S | 5/2016 | Oberpriller et al. |
| 9,342,723 | B2 | 5/2016 | Liu et al. |
| 9,342,724 | B2 | 5/2016 | McCloskey et al. |
| 9,360,304 | B2 | 6/2016 | Xue et al. |
| 9,361,882 | B2 | 6/2016 | Ressler et al. |
| 9,365,381 | B2 | 6/2016 | Colonel et al. |
| 9,373,018 | B2 | 6/2016 | Colavito et al. |
| 9,375,945 | B1 | 6/2016 | Bowles |
| 9,378,403 | B2 | 6/2016 | Wang et al. |
| D760,719 | S | 7/2016 | Zhou et al. |
| 9,383,848 | B2 | 7/2016 | Daghigh |
| 9,384,374 | B2 | 7/2016 | Bianconi |
| 9,390,596 | B1 | 7/2016 | Todeschini |
| D762,604 | S | 8/2016 | Fitch et al. |
| 9,411,386 | B2 | 8/2016 | Sauerwein, Jr. |
| 9,412,242 | B2 | 8/2016 | Van et al. |
| 9,418,269 | B2 | 8/2016 | Havens et al. |
| 9,418,270 | B2 | 8/2016 | Van et al. |
| 9,423,318 | B2 | 8/2016 | Liu et al. |
| D766,244 | S | 9/2016 | Zhou et al. |
| 9,443,123 | B2 | 9/2016 | Hejl |
| 9,443,222 | B2 | 9/2016 | Singel et al. |
| 9,454,689 | B2 | 9/2016 | McCloskey et al. |
| 9,464,885 | B2 | 10/2016 | Lloyd et al. |
| 9,465,967 | B2 | 10/2016 | Xian et al. |
| 9,478,113 | B2 | 10/2016 | Xie et al. |
| 9,478,983 | B2 | 10/2016 | Kather et al. |
| D771,631 | S | 11/2016 | Fitch et al. |
| 9,481,186 | B2 | 11/2016 | Bouverie et al. |
| 9,488,986 | B1 | 11/2016 | Solanki |
| 9,489,782 | B2 | 11/2016 | Payne et al. |
| 9,490,540 | B1 | 11/2016 | Davies et al. |
| 9,491,729 | B2 | 11/2016 | Rautiola et al. |
| 9,497,092 | B2 | 11/2016 | Gomez et al. |
| 9,507,974 | B1 | 11/2016 | Todeschini |
| 9,519,814 | B2 | 12/2016 | Cudzilo |

(56) References Cited

U.S. PATENT DOCUMENTS 9,521,331 B2 12/2016 Bessettes et al.
9,530,038 B2 12/2016 Xian et al.
D777,166 S 1/2017 Bidwell et al.
9,558,386 B2 1/2017 Yeakley
9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
2007/0030329 A1 2/2007 Wiens
2007/0063048 A1 3/2007 Havens et al.
2008/0030567 A1 2/2008 Busch et al.
2008/0211840 A1 9/2008 Zevin et al.
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2010/0321456 A1 12/2010 Tsuchihashi et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0016368 A1 1/2013 Bouverie et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedrao
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2014/0001267 A1 1/2014 Giordano et al.
2014/0002828 A1 1/2014 Laffargue et al.
2014/0025584 A1 1/2014 Liu et al.
2014/0034734 A1 2/2014 Sauerwein, Jr.
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078342 A1 3/2014 Li et al.
2014/0098792 A1 4/2014 Wang et al.
2014/0100774 A1 4/2014 Showering
2014/0100813 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein, Jr.
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0125853 A1 5/2014 Wang
2014/0125999 A1 5/2014 Longacre et al.
2014/0129378 A1 5/2014 Richardson
2014/0131443 A1 5/2014 Smith
2014/0131444 A1 5/2014 Wang
2014/0133379 A1 5/2014 Wang et al.
2014/0136208 A1 5/2014 Maltseff et al.
2014/0140585 A1 5/2014 Wang
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0168787 A1 6/2014 Wang et al.
2014/0175165 A1 6/2014 Havens et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 Digregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0351317 A1 11/2014 Smith et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0049347 A1 2/2015 Laffargue et al.
2015/0051992 A1 2/2015 Smith
2015/0053769 A1 2/2015 Thuries et al.
2015/0062366 A1 3/2015 Liu et al.
2015/0063215 A1 3/2015 Wang
2015/0088522 A1 3/2015 Hendrickson et al.
2015/0096872 A1 4/2015 Woodburn
2015/0100196 A1 4/2015 Hollifield
2015/0115035 A1 4/2015 Meier et al.
2015/0127791 A1 5/2015 Kosecki et al.
2015/0128116 A1 5/2015 Chen et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0186703 A1 7/2015 Chen et al.
2015/0199957 A1 7/2015 Funyak et al.
2015/0210199 A1 7/2015 Payne

(56) References Cited

U.S. PATENT DOCUMENTS

2015/0220753 A1 8/2015 Zhu et al.
2015/0254485 A1 9/2015 Feng et al.
2015/0310243 A1 10/2015 Ackley et al.
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue et al.
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0125873 A1 5/2016 Braho et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Franz
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini et al.
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 Dipiazza et al.
2016/0192051 A1 6/2016 Dipiazza et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggerty et al.
2016/0204636 A1 7/2016 Allen et al.
2016/0204638 A1 7/2016 Miraglia et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.
2016/0306769 A1 10/2016 Kohtz et al.
2016/0314276 A1 10/2016 Wilz et al.
2016/0314294 A1 10/2016 Kubler et al.
2016/0316190 A1 10/2016 McCloskey et al.
2016/0323310 A1 11/2016 Todeschini et al.
2016/0325677 A1 11/2016 Fitch et al.
2016/0327614 A1 11/2016 Young et al.
2016/0327930 A1 11/2016 Charpentier et al.
2016/0328762 A1 11/2016 Pape
2016/0330218 A1 11/2016 Hussey et al.
2016/0343163 A1 11/2016 Venkatesha et al.
2016/0343176 A1 11/2016 Ackley
2016/0364914 A1 12/2016 Todeschini
2016/0370220 A1 12/2016 Ackley et al.
2016/0372282 A1 12/2016 Bandringa
2016/0373847 A1 12/2016 Vargo et al.
2016/0377414 A1 12/2016 Thuries et al.
2016/0377417 A1 12/2016 Jovanovski et al.
2017/0010141 A1 1/2017 Ackley
2017/0010328 A1 1/2017 Mullen et al.
2017/0010780 A1 1/2017 Waldron et al.
2017/0016714 A1 1/2017 Laffargue et al.
2017/0018094 A1 1/2017 Todeschini
2017/0046603 A1 2/2017 Lee et al.
2017/0047864 A1 2/2017 Stang et al.
2017/0053146 A1 2/2017 Liu et al.
2017/0053147 A1 2/2017 Germaine et al.
2017/0053647 A1 2/2017 Nichols et al.
2017/0055606 A1 3/2017 Xu et al.
2017/0060316 A1 3/2017 Larson
2017/0061961 A1 3/2017 Nichols et al.
2017/0064634 A1 3/2017 Van et al.
2017/0083730 A1 3/2017 Feng et al.
2017/0091502 A1 3/2017 Furlong et al.
2017/0091706 A1 3/2017 Lloyd et al.
2017/0091741 A1 3/2017 Todeschini
2017/0091904 A1 3/2017 Ventress, Jr.
2017/0092908 A1 3/2017 Chaney
2017/0094238 A1 3/2017 Germaine et al.
2017/0096021 A1* 4/2017 Bouverie ..... B41J 17/36
2017/0098947 A1 4/2017 Wolski
2017/0100949 A1 4/2017 Celinder et al.
2017/0108838 A1 4/2017 Todeschini et al.
2017/0108895 A1 4/2017 Chamberlin et al.
2017/0118355 A1 4/2017 Wong et al.
2017/0123598 A1 5/2017 Phan et al.
2017/0124369 A1 5/2017 Rueblinger et al.
2017/0124396 A1 5/2017 Todeschini et al.
2017/0124687 A1 5/2017 McCloskey et al.
2017/0126873 A1 5/2017 McGary et al.
2017/0126904 A1 5/2017 D'Armancourt et al.
2017/0139012 A1 5/2017 Smith
2017/0140329 A1 5/2017 Bernhardt et al.
2017/0140731 A1 5/2017 Smith
2017/0147847 A1 5/2017 Berggren et al.
2017/0150124 A1 5/2017 Thuries
2017/0169198 A1 6/2017 Nichols
2017/0171035 A1 6/2017 Lu et al.
2017/0171703 A1 6/2017 Maheswaranathan
2017/0171803 A1 6/2017 Maheswaranathan
2017/0180359 A1 6/2017 Wolski et al.
2017/0180577 A1 6/2017 Nguon et al.
2017/0181299 A1 6/2017 Shi et al.
2017/0190192 A1 7/2017 Delario et al.
2017/0193432 A1 7/2017 Bernhardt
2017/0193461 A1 7/2017 Celinder et al.
2017/0193727 A1 7/2017 Van et al.

(56) References Cited

U.S. PATENT DOCUMENTS

| | | | |
|---|---|---|---|
| 2017/0200108 | A1 | 7/2017 | Au et al. |
| 2017/0200275 | A1 | 7/2017 | Mccloskey et al. |

OTHER PUBLICATIONS

Office Action for related U.S. Appl. No. 15/696,359, dated Oct. 4, 2018, 10 pages.
Restriction Requirement for U.S. Appl. No. 15/696,359, dated Jun. 26, 2018, 10 pages.

* cited by examiner

Exemplary Thermal Printer

FIG. 2 Exemplary Printhead and Platen Applied to Two Different Print Media
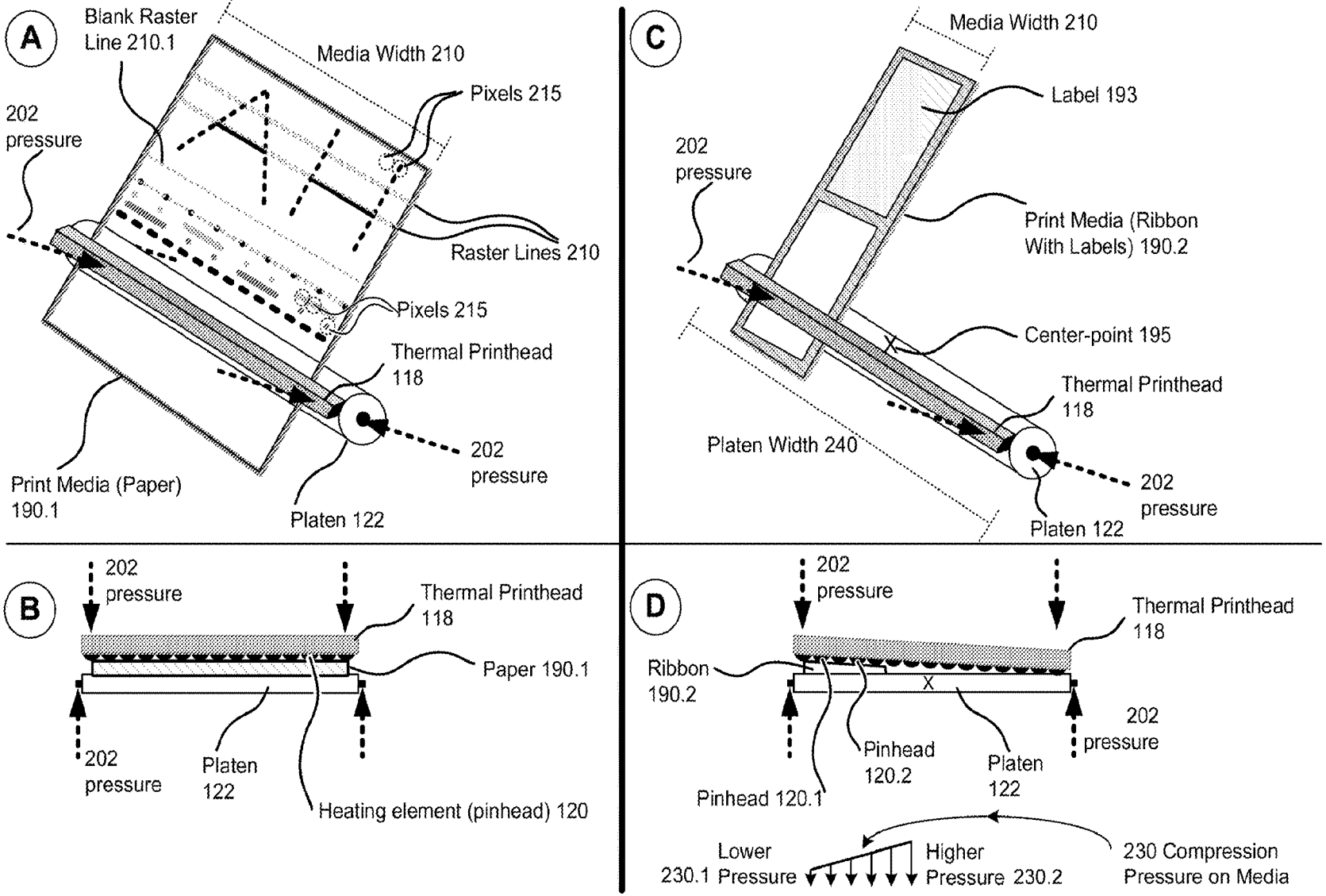

FIG. 3 Exemplary Method for Consistent Print Contrast
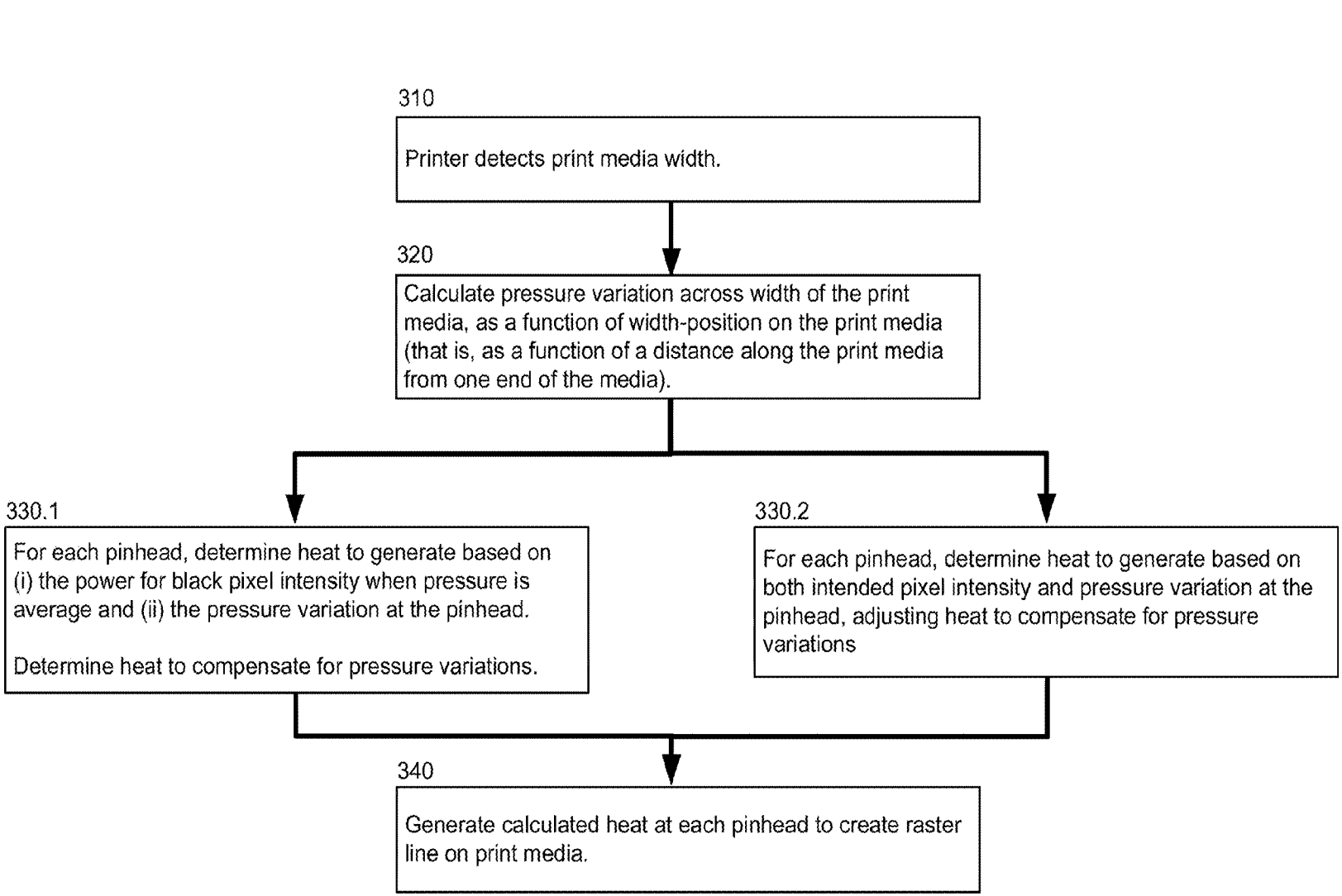

FIG. 4 Pressure and Heat Calculations
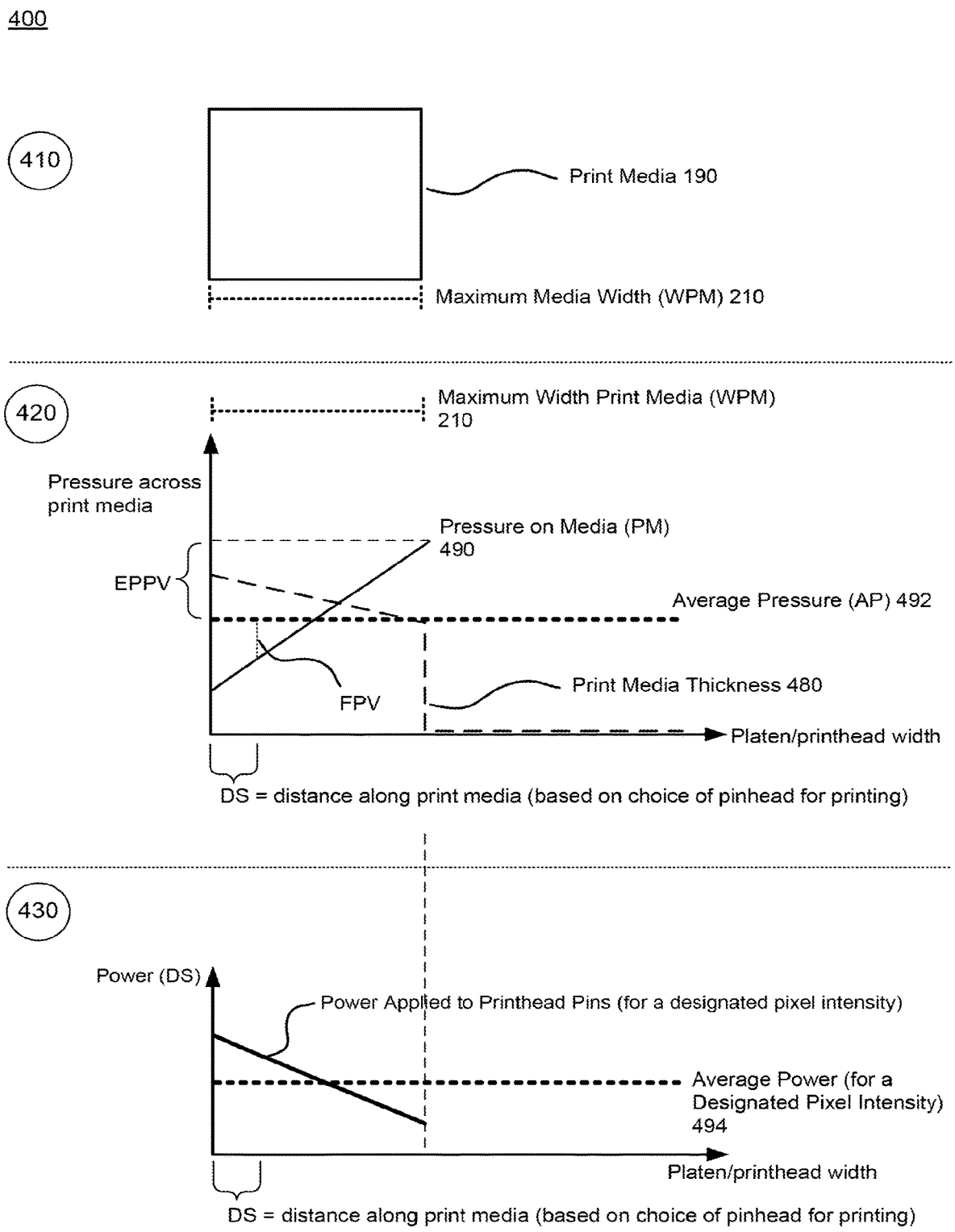

FIG. 5 Detecting Media Width
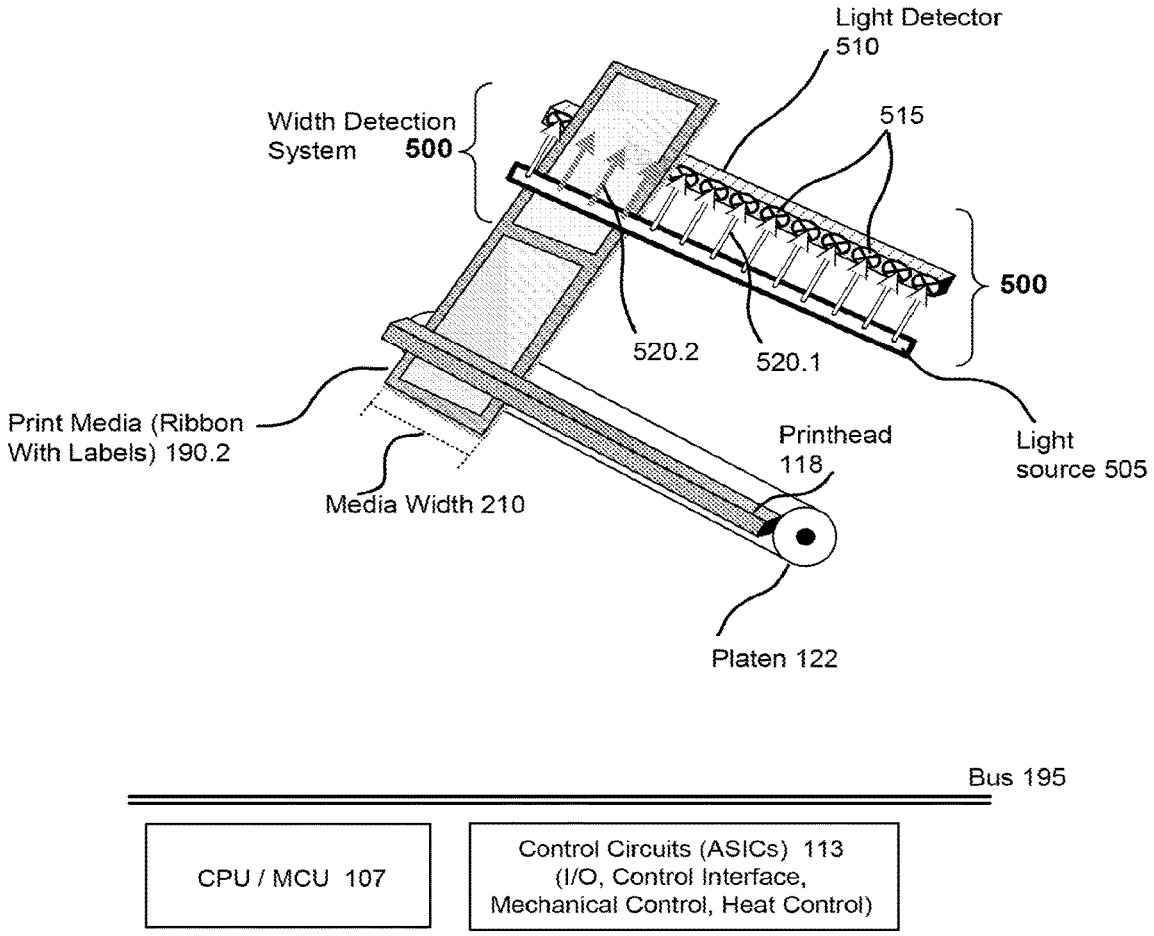
$$\text{Media_Width} = \text{Maximum_Media_Width} * \left( \frac{\text{Number_Of_Photoreceptors_Which_Receive_Light}}{\text{Total_Number_Of_Photoreceptors}} \right)$$

AUTOCORRECTION FOR UNEVEN PRINT PRESSURE ON PRINT MEDIA

CROSS-REFERENCE TO RELATED APPLICATIONS

This application is a continuation of U.S. application Ser. No. 15/696,359 entitled Autocorrection For Uneven Print Pressure On Print Media filed Sep. 6, 2017, each of which is incorporated herein by reference in its entirety.

FIELD OF THE INVENTION

The present invention relates to printing, via a printer, onto a print media such as labels. More specifically, the invention relates to maintaining a strong, clear, uniform print density on the media when the pressure applied by a printhead varies along the length or width of the print media.

BACKGROUND

Home and office printers typically are used to print upon print media, such as paper and labels. Many printers, such as inkjet printers and thermal printers, employ the elements of a printhead and platen. Mechanical feed mechanisms feed a sheet of print media (such as paper, or a label or sheet of labels) between the printhead and the platen.

For many printers, a necessary component of the printing process is that pressure be applied by the printhead to the print media. The printhead presses on the print media, which is in turn supported by the platen.

For a print process to provide a consistent density of printing across the width of a print media, it is often desirable that the pressure on the print media should be consistent across the print media. Put another way, the pressure exerted on the print media by the printhead on one side of the media sheet, and the platen on the other side of the media sheet, should be consistent across the width of the media.

In some cases—for example, standard 8.5 inch by 11 inch paper fed through a typical office or home printer—the width of the print substantially spans the width of the printhead and the platen. In such cases, the printhead and the platen will tend to naturally exert a consistent level of pressure across the width of the print media.

Some print media, however, such as some labels fed through a printer, may not span the full width of the printhead and platen. If the labels span substantially less than the full width of the printhead/platen elements, the pressure across the print media may be uneven. In turn, if the pressure on the print media is uneven, the resulting print process may induce inconsistent levels of print on the media. That is, the print may be excessively dark towards one end of the print media and excessively light towards the other end of the print media.

What is needed, then, is a system and method for printing which identifies uneven pressure on a print media, and compensates for the uneven pressure, thereby ensuring consistent print density across the print media.

SUMMARY

Accordingly, in one aspect, the present invention embraces a printer configured to identify uneven print pressure on the print media, and to compensate for the uneven print pressure by varying the intensity of an applied contrast-inducing element (for example, and without limitation, heat) on the print media.

In an embodiment of the present system and method, the contrast-inducing element may be heat generated at points along the printhead, where the heat either (i) induces contrast on a heat-sensitive print media or (ii) melts ink from an ink ribbon on the print media.

In an exemplary embodiment, where the pressure on the print media is relatively more heavy towards a first end of the platen and printhead, the printhead is configured to apply a proportionate, relatively lesser intensity of the contrast-inducing element. Where the pressure on the print media is relatively less heavy towards a second, opposing end of the platen and printhead, the printhead is configured to apply a relatively greater intensity of the contrast-inducing element. Where the pressure on the print media is at a relative pressure midpoint, the printhead is configured to apply a relatively middle level of the contrast-inducing element. In this way, a consistent level of print density is achieved across the width of the print media.

In another aspect, the present invention embraces a method for a printer to identify uneven print pressure on the print media, and to compensate for the uneven print pressure by varying the intensity of an applied contrast-inducing element on the print media.

In an embodiment, where the pressure on the print media is relatively more heavy, the method regulates the printhead to apply a proportionate, relatively lesser intensity of the contrast-inducing element. Where the pressure on the print media is relatively less heavy, the method regulates the printhead to apply a relatively greater intensity of the contrast-inducing element. Where the pressure on the print media is at a relative pressure midpoint, the method regulates the printhead to apply a relatively middle level of the contrast-inducing element. In this way, a consistent level of print density is achieved across the width of the print media.

In an exemplary embodiment, pressure variation on the print media is determined by measuring the width of the print media, and comparing the width of the print media to the width of the printhead/platen combination.

As indicated above, in one exemplary embodiment the printer is a thermal printer, and the print media is thermal print media. The contrast-inducing element applied by the printhead is heat, and the intensity of the heat applied across the width of the printhead is varied to compensate for the pressure variations.

In yet another exemplary embodiment, the printer is an inkjet printer, and the print media is paper or labels. The contrast-inducing element applied by the printhead is ink, and the time or pressure of application of ink, applied across the width of the printhead, is varied to compensate for the pressure variations.

In yet another exemplary embodiment, the printer is a laser printer, and the print media is paper or labels. The contrast-inducing elements applied are both light and toner. Either or both of the light intensity or the density of toner, applied across the width of the paper by one or more printhead elements, is varied to compensate for the pressure variations.

The foregoing illustrative summary, as well as other exemplary objectives and/or advantages of the invention, and the manner in which the same are accomplished, are further explained within the following detailed description and its accompanying drawings.

BRIEF DESCRIPTION OF THE DRAWINGS

FIG. 2 schematically depicts how variations in the width and placement of a print media may result in a consistent pressure across the print media or may result in an inconsistent pressure across the print media.

FIG. 3 is a flow chart of an exemplary method to provide for consistent print contrast across the width of the print media in response to pressure variations on the print media.

FIG. 4 graphically illustrates an exemplary calculation to determine pressure variations across print media based on media width.

FIG. 5 illustrates an exemplary width detection system, internal to a printer, which employs light (illumination) to determine the width of print media.

DETAILED DESCRIPTION

Figure 1:
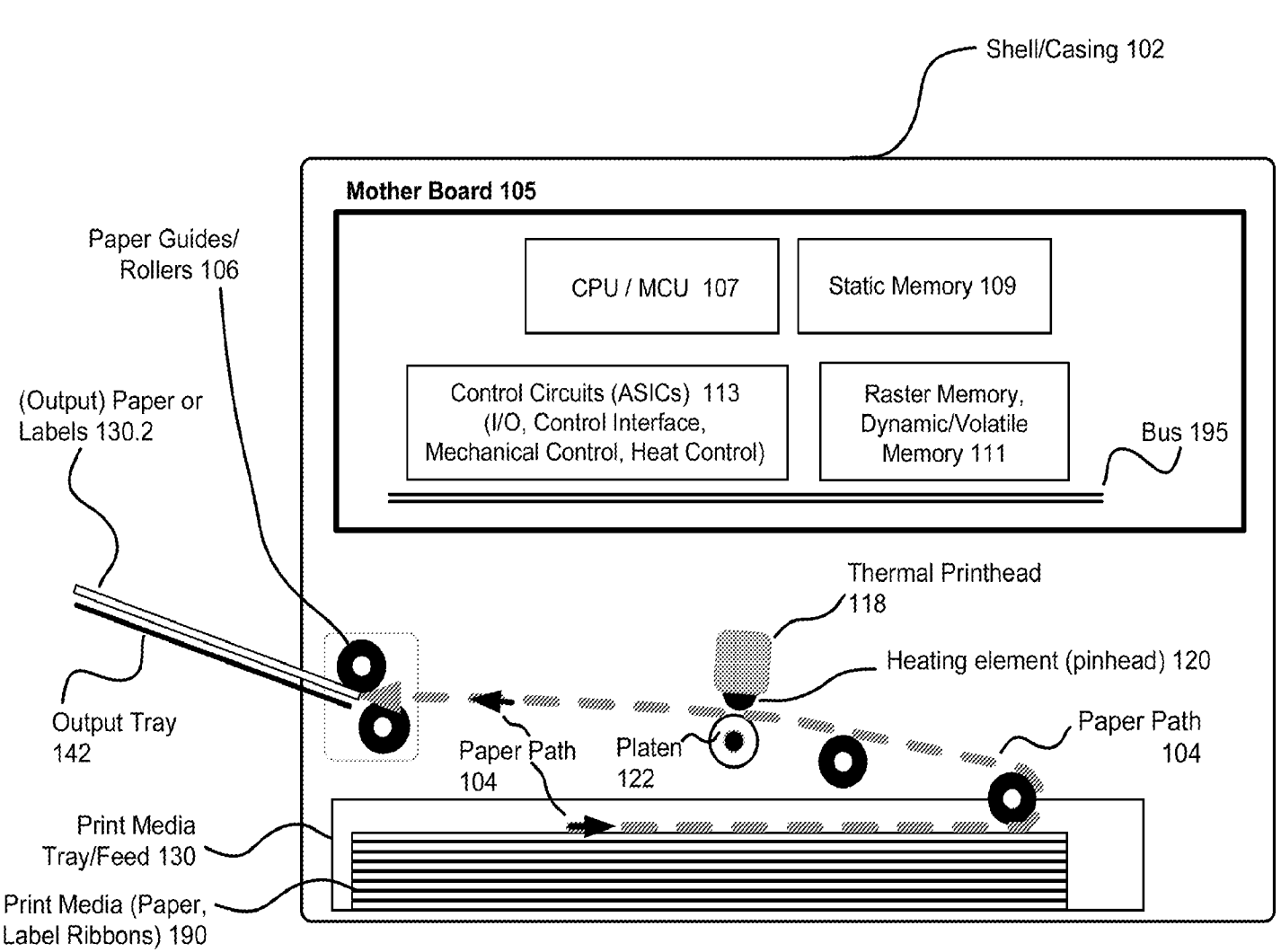
FIG. 1 schematically depicts some elements of an exemplary printer.

In the following description, certain specific details are set forth in order to provide a thorough understanding of various embodiments. However, one skilled in the art will understand that the invention may be practiced without these details. In other instances, well-known structures associated with computers, with printers, with electromechanical digital devices, with other digital devices, with data display, and/or with data storage or data transmission, have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open sense, that is as "including, but not limited to."

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the claimed invention.

REFERENCE NUMBERS

Reference numbers are used throughout the figures, and the first digit of a reference number generally indicates the first drawing where the associated element appears. For example, an element 207 first appears in FIG. 2. In some instances, an element may be shown in both a generic form and a more specific form or species; in these cases, the specific form or species may be indicated by an appended period (".") followed by a digit or digits to distinguish a species of the general form. For example, a general print media may have a reference number 190; while a sheet of paper may have a reference number 190.1, a mailing label may have a reference number 190.2, and a sheet of acetate may have a reference number 190.3.

Terminology

Print Media, Physical Print Media, Paper, Labels: The terms print media, physical print media, paper, and labels 190 (see FIG. 1) are used in this document to refer to tangible, substantially durable physical material, which is manufactured, and which is typically thin and flat but pliant, onto which text, graphics or images may be imprinted and persistently retained over time. Typical physical print media are often used for product labeling, item labeling, mailing labels, personal communications, business communications, and to convey prose expression, data, advertising, fiction, entertainment content, illustrations, and pictures.

Typical print media are often derivatives of wood pulp or polymers, and include conventional office paper, clear or tinted acetate media, news print, envelopes, mailing labels, product labels, and other kinds of labels. Thicker materials, such as cardstock or cardboard may be included as well.

Print media have a thickness, so that when fed through a printer they impose a gap between a printhead and a print platen. Typical commercial papers, such as those conventionally used in laser printers and thermal printers, generally vary in thickness from approximately 0.003" to 0.007".

In exemplary embodiments discussed throughout this document, reference may be made specifically to "paper" or "labels" 190; but it will be understood by persons skilled in the relevant arts that the operations, system elements, and methods of such exemplary applications may be applicable to media other than or in addition to the specifically mentioned "paper" or "labels."

Contrast-inducing elements: A contrast-inducing element may be heat or light, or other forms of energy. The print media may itself be designed, for example with chemical coatings, so that its surface contrast, color, or shading can be selectively varied (for example, through selective application by the printer of heat or light) to create a persistent visual contrast.

Alternatively, for use in some printers, during a print process, print media is used to receive contrast-inducing elements such as ink, dye, or toner to create a persistent visual contrast (in black and white, shades of gray, and/or colors).

The persistent visual contrast on the print media, once induced by the printer, can be perceived by the human eye as text, images, shapes, symbols, or graphics.

Printer: A printer 100 (see FIG. 1) is a device which imprints text, images, shapes, symbols, or graphics onto print media to create a persistent, human-readable representation of the text, images, shapes, symbols, or graphics. Common types of contemporary printers include laser printers, light-emitting diode (LED) printers, inkjet printers, and thermal printers, as well as older technologies such as dot matrix printers, impact printers, and line printers.

Typically, printers 100 are designed so that one or more sheets of paper, or one or more labels, or other print media, can be inserted or "fed" into the printer. In typical operation, multiple sheets, print media ribbons, or other media are inserted into a holding tray or other container element of the printer for temporary storage; in alternative embodiments, individual sheets of print media or individual labels may be hand-fed into a printer one at a time.

Command and content instructions are then sent to the printer electronically, for example from an external computer which is communicatively linked to the printer; the printer feeds a sheet of paper, or a label, or other print media into itself, towards a printhead within the printer; and the printhead of the printer then induces contrast (color) on the print media to imprint the appropriate contents onto the print media.

Exemplary Thermal Printer

The present system and method may be applicable to multiple different kinds of printers, including but not limited to thermal printers, LED printers, inkjet printers, laser printers, and other kinds of printers as well.

The present invention embraces a printer which provides consistent print density on a print media by using:

(i) variations in the intensity of an applied contrast-inducing element (for example and without limitation, heat) to compensate for . . . .

(ii) . . . a variation of printhead pressure across the print media.

The exemplary embodiment described below pertains to an exemplary thermal printer. However, persons skilled in the relevant arts will appreciate that the system and method may be applied in other kinds of printers as well, including inkjet printers, LED printers, and laser printers.

FIG. 1 illustrates some exemplary elements of an exemplary thermal printer 100. Many elements of a thermal printer are omitted from the figure, which features mainly elements that contribute to an understanding of the present system and method. Some reference is also made here to FIG. 2, which is further discussed in greater detail below.

Print Process—

Elements of printer 100 are presented here in the context of an exemplary print process which may employed by exemplary thermal printer 100:

Print Step (1), Raster Image Processing:

The document to be printed is encoded in a page description language such as PostScript, Printer Command Language (PCL), or Open XML Paper Specification (OpenXPS). This is typically performed by an external computer (not illustrated) which is connected to printer 100. In some cases, however, the source document is encoded on printer 100 itself, for example if printer 100 functions in a dual role as a document scanner. (Scanning elements are not illustrated in the figure.) In alternative embodiments, printer 100 receives the page in the form of an image (such as a graphics file, for example JPG or PNG) from an external device (for example, a computer or an external scanner).

Raster Lines (Scan Lines):

A raster image processor converts the page description into a bitmap which is stored in the printer's raster memory 111. Each horizontal strip of dots (also referred to as "pixels" 215) across the raster page is known as a raster line 210, and equivalently as a scan line 210 (see FIG. 2, discussed further below). In an embodiment, raster image processing may be performed by the hardware microprocessor of an external computer (for example, the same computer which generates the page description language). In an alternative embodiment, the conversion from a page description language to a raster image is performed on printer 100 itself, for example by central processing unit (CPU/MCU) 107 employing instructions stored in the printer's static memory 109.

Persons skilled in the relevant arts will appreciate that a "raster line" 210 is generally not the same as a "line" of text in a document. Depending on the dot-per-inch resolution of the print process and the point size of a printed line of text, a single line of text may typically be composed of anywhere from a few dozen raster lines to well over one hundred raster lines.

Print Step (2), Paper Feed:

Print media 190, such as individual sheets of paper, sheets with mailing labels, or a ribbon of labels, are fed into the printer via a media feed or tray 130. The print media 190 is routed through the printer to a printhead via guides 106, rollers 106, and/or other suitable media routing mechanics.

Print Step (3), Printing Raster Lines:

Printer 100 may use a variety of printheads and printing mechanisms to create contrast (typically black/white, gray-scale contrast, and/or colors) to print media 190. Inkjet printers directly print ink onto the print media 190, while laser printers employ a complex combination of light, electrostatic charge, and toner to create contrast on the print media 190.

Exemplary thermal printer 100 employs a thermal printhead 118 with a series of heating elements 120, also referred to as "pinheads", "pin dots", or simply "dots" 120, which are closely spaced along the length of the thermal printhead 118. In an embodiment of the present system and method, a thermal print media 190, which may include for example thermal paper and thermal labels, is heat sensitive. Under the control of CPU 107, and possibly control circuits 113, heating elements 120 of thermal printhead 118 are heated to varying temperatures during the print process. The heat induces contrast on the thermal print media 190. In an alternative embodiment (not illustrated in the figures) printer 100 employs an ink ribbon, which is a ribbon substrate with ink on it. The heat from heating elements 120 melts the ink from the ribbon onto print media 190, and the transferred ink is the source of the contrast on the print media 190.

Generation of Raster Lines:

The final output is typically composed of numerous raster lines 210 (see again FIG. 2, below), all parallel to each other and closely spaced or touching each other. The intensity/darkness of each pixel 215 in a raster line is correlated with the heat applied by a corresponding heating element 120 as the print media 190 passes underneath the thermal printhead 118.

In an alternative embodiment (not illustrated in the figures) printer 100 may employ a black print media 190 or other dark colored printer media 190. An ink ribbon with white ink or other light colored ink is then used. Heating elements 120 then melt the white/light-colored ink onto the dark print media 190. The degree of whiteness, that is, the intensity, of the resulting print or image (on the dark background) is proportional to the amount of heat employed. In this document, and for convenience of exposition only, it is generally assumed that print media 190 is white or light-colored, and any print or image which is then imprinted on the media is black, a shade of gray, or some color which presents contrast from the white print media.

Pressure of the Print Media, Heat from the Printhead, and Induced Contrast:

It will be noted from FIG. 1 that as print media 190 passes under thermal printhead 118, print media 190 is sandwiched or trapped between thermal printhead 118 and platen 122. Platen 122 may be a roller, which in an embodiment may have a rubber surface or other flexible surface. As print media 190 passes between thermal printhead 118 and platen 122, thermal printhead 118 may impress itself directly upon print media 190, causing contact on print media 190 by heating elements 120 of printhead 118.

In an embodiment of the present system and method, the induced contrast at a pixel point on print media 190 is proportionate to both the heat applied by a heating element 120 and the pressure applied by the same heating element 120. In an embodiment, print media 190 may be white or some other non-black color. Heat from a heating element 120 may induce a black or gray pixel 215 on print media 190. The darkness of a pixel 215 on a raster line 210 may increase with both increased heat and with increased pressure. If a consistent pressure is maintained during the print process, then the darkness of a pixel 215 on a raster line 210 increases in proportion with increased heat from a heating element 120.

Put another way: In an embodiment, print media 190 may be white or some other non-black color. Heat from a heating element 120 may induce a black or gray pixel on print media 190. The darkness of a pixel on a raster line increases with both increased heat, and with increased pressure. But if the pressure on print media 190 is consistent across the full width of the thermal printhead 118, then for all pixels across the width of the page, the darkness of any pixel will be consistent for a given level of applied heat at that pixel.

Print Step (4), Printing Multiple Raster Lines and Paper Release.

Printing the full print media is accomplished by continuing to feed the print media 190 through the printer, and repeating step (3) above multiple times, to print multiple successive raster lines. The multiple raster lines will create a completed image (text, graphics, or similar) on print media 190. The print media is then released from printer 100 via output tray 142.

Other Exemplary Printer Elements

Exemplary thermal printer 100 may employ other elements as well. Printer 100 may have an external shell or casing 102 which houses most or all of the printer elements. Control elements and paper feed elements may be partly or wholly on the exterior of external casing 102.

One or more motors and other electromechanical mechanisms, not illustrated in the figure, are typically employed for effectuating transfer of paper 100 and materials within printer 100.

A motherboard 105 typically holds and interconnects various microchips used to control and monitor printer 100. Motherboard 105 may include, for example and without limitation:

A central processing unit (CPU) 107 or microcontroller unit (MCU) 107 which provides for overall operational control of printer 100. This includes monitoring printer operations via sensors (not illustrated), and directing printer operations via various application specific integrated circuits (ASICs) 113 discussed further below.

Static memory 109 may store non-volatile operational code (such as internal device drivers) for printer 100. CPU 107 may employ the code stored in static memory 109 in order to maintain the operational control of printer 100.

Volatile memory 111, such as dynamic RAM (DRAM), may be used to store data received from external computers, such as page descriptions, raster images, and other data pertinent to the printing of particular documents.

Control of printer 100 may be maintained in various ways. In some embodiments, CPU 107 of printer 100 may directly control various elements of the printer (such as thermal printhead 118, motors and other mechanical servers, etc.). In other instances, control may be effectuated by CPU 107 via various application specific integrated circuits (ASICs) 113 which act as intermediary control circuits.

Control circuits 113 may support such functions as external input/output (for example, via USB ports, an Ethernet port, or wireless communications, not illustrated in the figure); a control interface for a user control panel or wireless remote on the outside of the printer (not illustrated in the figure); mechanical control of motors and other electromechanical elements; and control of thermal printhead 118.

A system bus 195 may serve to transfer data and messages between elements of motherboard 105, and between motherboard 105 and various other microchips, controllers, and sensors of printer 100.

Other Printer Embodiments:

Different printers 100 implement these steps described above in distinct ways, and some elements may be referred to by other terms or generic terms. For example, the elements directly responsible for printing onto the print media 100 may be referred to generically as the printhead 118.

Source of Pressure Variation on Print Media

FIG. 2 provides several views (in panels (A), (B), (C), and (D)) of some exemplary elements of exemplary thermal printer 100.1. As will be apparent from the discussion below, the views illustrate how pressure applied across a print media 190 may be substantially even and consistent across the width 201 of the print media, or how the pressure applied across the print media 190 may vary during printing.

It will be noted from FIG. 2 that the width of the print media is measure of the edge-to-edge distance across the print media 190 in a direction parallel to the direction of both thermal printhead 118 and platen 122, as print media 190 is oriented when being fed through the printer 100 for printing.

Panel (A):

Panel (A) of FIG. 2 illustrates an exemplary sheet of paper 190.1 being fed between thermal printhead 118 and platen 122. As illustrated in the figure, the width of exemplary paper 190.1 nearly or substantially spans the width of both thermal printhead 118 and platen 122. Moreover, paper 190.1 is fed so as to be substantially centered between the ends of both thermal printhead 118 and platen 122.

Thermal printhead 118 and platen 122 are parallel too each other and configured to be in contact with each other if no print media 190 is between them.

In an embodiment of the present system and method, a contact pressure is applied to both thermal printhead 118 and platen 122 at suitable support points (typically at or near the ends of each element), with the contact pressure on each element opposing the contact pressure on the other. When no paper 190.1 is present between thermal printhead 118 and platen 122, then thermal printhead 118 and platen 122 are directly in contact and pressing against each other. Persons skilled in the art will recognize that such contact pressure may be provided by a variety of structural elements of printer 100, including interior support elements which may be flexible and provide tension or pressure, as well as springs, which are not illustrated in the figures. The direction of the opposing contact pressures is indicated by pressure arrows 202 (shown as dotted lines in the figure).

In an embodiment of the present system and method, platen 122 may have a compressible coating, such as rubber, which can compress to permit print media 190 to be interposed between platen 122 and thermal printhead 118.

Raster Lines:

Also illustrated in Panel (A) are some exemplary raster lines 210, showing the results of printing the letters "AH" as well as some pattern of raster lines 210 which may for example be part of a drawing, photograph, or graph. Persons skilled in the art will appreciate that only a few exemplary raster lines 210 are illustrated, and that the entire image is composed of successive raster lines 210 (which may include one or more entirely blank lines 210.1).

For purposes of illustration only of some exemplary raster lines and their orientation on print media 190, blank or empty portions of raster lines 210 are shown in FIG. 2 as dotted and shaded light gray. Raster lines 210 are oriented parallel to the length of thermal printhead 118 and platen 122.

For purposes of illustration and clarity of exposition only, and to clearly distinguish individual exemplary raster lines 210, the handful of exemplary raster lines 210 are shown in Panel (A) as separated by from each other, when in actual printing the full page is composed of many more substantially adjacent raster lines 210. For example, a 300 dot-per-inch (dpi) printing process which runs ten inches from top to bottom of the page may be composed of 10*300=3000 raster lines (some of which may, however, be blank or white raster lines).

Typically, except where white space is actually required in the shaping of alphanumeric text or in figures, raster lines 210 which employ contrast (that is, are not white across their entire length) are printed sufficiently close together, or even slightly overlapping, so as to create smooth, continuous image elements. In the figure, adjacent pixels 215 on a common, same raster line 210 are shown as adjacent and continuous, where applicable (such as the horizontal "bar" elements of the letters "A" and "H").

Pixels:

A raster line may include any of black pixels 215, white pixels 215 (or more generally clear pixels 215, which simply reveal the underlying color of print media 190), colored pixels 215, and various intensities of pixels 215 (such as grayscale pixels or intensities of color pixels).

Panel (B):

Panel (B) presents another view of the elements shown in panel (A), including the full-width, centered paper 190.1

When paper 190.1 is fed between thermal printhead 118 and platen 122, paper 190.1 is subject to compression pressure along its width from the elements thermal printhead 118 and platen 122. In an embodiment of the present system and method, pressure 202 is applied equally at both ends of the pairing of printhead 118 and platen 122. In an alternative embodiment, pressure may be applied at multiple points along thermal printhead 118, but with the same level of pressure applied at each point. Because paper 190.1 substantially spans the width of thermal printhead 118 and platen 122, and is also substantially centered between the ends of both thermal printhead 118 and platen 122, paper 190.1 is subject to substantially consistent pressure along its entire width.

As a result, the pressure applied to paper 190.1 is substantially the same at each heating element 120 of thermal printhead 118. As a further result, the contrast induced on paper 190.1 at each specific heating element 120 depends only on the heat generated by that specific heating element 120. The heat generated at a pinhead 120 results from both the amount of electric power applied at the pinhead and the time duration of the power. Due to the consistent pressure along thermal printhead 118: If a same amount of power is applied at two (or more) different pinheads 122 along thermal printhead 118, a same amount of contrast is induced on print media 190 at the pixel generated by each such pinhead.

Panel (C):

Panel (C) of FIG. 2 illustrates a strip or ribbon of labels 190.2 being fed between thermal printhead 118 and platen 122. (An individual label is indicated with reference number 193. The ribbon 190.2 typically has a backing made of a glossy paper or similar substrate, with labels 193 affixed by an adhesive.)

As illustrated in the figure, the width of ribbon 190.2 is substantially less than the width of both thermal printhead 118 and platen 122, and is therefore referred to as a "narrow" ribbon 190.2, or more generally as a "narrow print media" 190.2. Moreover, the narrow print media 190.2 is fed so as to be substantially proximate to a common end of both thermal printhead 118 and platen 122, so that ribbon 190.2 is substantially off-center from a common center point ("X") 195 of both thermal printhead 118 and platen 122.

In an embodiment of the present system and method, substantially the same pressures 202 are applied to thermal printhead 118 and platen 122 at the support points.

Panel (D):

Panel (D) presents another view of the elements shown in panel (C), including the narrow, off-center ribbon 190.2. Unlike in the case for full-width paper 190.1 (as in panels (A) and (B)), because label ribbon 190.2 is narrow in width and is off-center, the effective applied pressure from thermal printhead 118 is NOT distributed uniformly along label ribbon 190.2.

Instead, label ribbon 190.2 functions as a fulcrum around which thermal printhead 118 is subject to a small but significant torque, as illustrated in panel (D). This results in ribbon 190.2 being compressed more at a first end, least at a second end, and in relative variations of pressure along its width.

When ribbon 190.2 is fed between thermal printhead 118 and platen 122, ribbon 190.2 is effectively subject to varied compression pressure 230 along its width from platen 122, and therefore varied pressure from the heating elements of thermal printhead 118. For example, at a first pinhead 120.1 there may be a pressure on ribbon 190.2 which is less than the average overall pressure; while at a second pinhead 120.2 there may be a pressure on ribbon 190.2 which is greater than the average overall compression pressure 230 on ribbon 190.2.

Print Contrast Inducement on Thermal Media

As is well known in the art, a thermal printhead 118 induces contrast on thermal print media 190 by the application of heat. In embodiments, the normal or typical background color of the thermal print media 190 may be white. In an embodiment, the application of heat induces in the thermal print media 118 various shades of gray up to and typically including a substantially black pixel. This is due to a heat-responsive chemical coating on the thermal print media 190. In an alternative embodiment, the thermal printhead melts ink from a print ribbon (not shown in the figures) onto the thermal print media 190.

The thermal printhead 118 applies heat from a linear row of consecutive, adjacent, and typically equally spaced heating elements (pinheads) 120. The pinheads 120 are heated by a current running through them. In an embodiment of the present system and method, the application of heat from pinheads 120 entails contact between the pinheads 120 and the thermal print media 190. In an alternative embodiment, the application of heat entails contact between the pinheads 120 and an ink ribbon (not shown in the figures), where the ink ribbon in turn has contact with print media 190. In either embodiment, pinheads 120 typically apply a pressure to the print media 190, which in some embodiments may be in the range of 30 kg-Newtons to 40 kg-Newtons.

The heat applied by a pinhead 120 may range from 50 degrees to 70 degrees Fahrenheit, up to 80 or even 90 degrees Fahrenheit. Higher temperatures results in higher contrast inducement, that is, darker (blacker) pixels.

As the print media 190 is mechanically advanced through printer 100, printhead 118 applies a series of raster lines 210 in rapid succession. Each raster line 210 is composed of multiple pixels 215 (which may include white "pixels", if no heat is applied by a pinhead 120). As per above, pixels 215 vary in darkness from white to various shades of gray to black, with darker pixels resulting from the application of more heat by a pinhead 120. The accumulation of successive printed raster lines 210 results in the final two-dimensional printed image.

Pixel Darkness Dependent on Heat and Pressure:

The darkness of a pixel 215 printed on media 190 depends on both the pressure applied and the heat applied.

For purposes of illustration only, this document employs an exemplary scale for heat, pressure, and resulting pixel lightness/darkness for exemplary thermal printer 100. In various embodiments of the present system and method, and depending on the particular design of printer 100, the amount of heat and pressure required to generate a pixel 215 of a given intensity may vary from the exemplary numbers in the tables below.

Uniform Pressure:

In a first exemplary case, thermal printhead 118 may apply a substantially uniform pressure across the width of print media 190, for example 35 kg-Newtons. This corresponds to the exemplary print example of FIG. 2, panels (A) and (B), where the width of print media 190 substantially spans the width of platen 122 and thermal printhead 118, and print media 190 is substantially centered as well. The resulting pixel intensities on print media 190 may then be indicated by exemplary Table 1 as follows:

TABLE 1

| | Pin Temperature | | | | |
|---|---|---|---|---|---|
| | 50° | 60° | 70° | 80° | 90° |
| Induced Pixel Color | White | Light Gray | Med. Gray | Dark Gray | Black |
| Induced Pixel Intensity (percentage black) | 0% | 25% | 50% | 75% | 100% |

Persons skilled in the relevant arts will recognize that other temperatures may be applied as well, with corresponding intermediate pixel intensities. In the exemplary case shown in Table 1, for instance, application of 65° (halfway between 60° and 70°) may result in a "light-to-medium gray" pixel, with an intensity of approximately 37% blackness.

It is apparent that with uniform pressure 202 across the width of print media 190, pixel intensities correlate with the temperature only at a pinhead 120. This results in uniformly consistent pixel intensities, for a given pinhead temperature, across the width of print media 190.

Non-Uniform Pressure:

in a second exemplary case, thermal printhead 118 may apply a substantially non-uniform pressure across the width of print media 190, for example ranging from 30 kg-Newtons to 40 kg-Newtons. This corresponds to the exemplary print example of FIG. 2, panels (C) and (D), where the width of print media 190 is substantially narrower than the width of platen 122 and thermal printhead 118, and print media 190 is substantially off-center on platen 122 and thermal printhead 118. The resulting pixel intensities on print media 190 may then be indicated by exemplary Table 2 as follows:

TABLE 2

| | Pin Temperature | | | | |
|---|---|---|---|---|---|
| Pressure | 50° | 60° | 70° | 80° | 90° |
| 30 kg-Newton | White/0% | White/0% | Light Gray/25% | Medium Gray/50% | Dark Gray/75% |
| 35 kg-Newton | White/0% | Light Gray/25% | Medium Gray/50% | Dark Gray/75% | Black/100% |
| 40 kg-Newton | Light Gray/25% | Medium Gray/50% | Dark Gray/75% | Black/100% | Excess Black/125% |

In Table 2, each body non-header cell in the table indicates Induced Pixel Color/Induced Pixel Intensity (percentage blackness).

As suggested by exemplary Table 2, if the pressure varies across the print media, then application of a same temperature (for example, 70 degrees) by a pinhead 120 will result in different pixel intensities for different pin pressures. At the extreme end of high temperature (for example, 90 degrees) with maximum pressure (for example, 40 kg-Newton), the pin may induce an excess contrast, forming an unacceptably large black pixel on print media 190. (This is indicated in the table by the 125% value of blackness, indicating a pixel which may "bleed" over in pixel size, resulting in a smeared image or blurred edges.) The result can be smudging or blurring of the final output.

Here again, persons skilled in the relevant arts will recognize that other temperatures and pressures may be applied as well, with corresponding intermediate pixel intensities. In the exemplary case shown in Table 2, for instance, application of 65° at 30 kg-Newton may result in a "very light gray" pixel, with an intensity of approximately 12% or 13% on the numeric scale. Similarly, application of 70° at 32.5 kg-Newton may result in the "light-to-medium gray" pixel, with an intensity of approximately 37% to 38% on the numeric scale.

In general: Uneven pressure across the width of print media 190, combined with a standard use of pin temperatures intended for consistent print pressures (as per Table 1 above), may result in inconsistent print output on print media 190. Inconsistent print output may be in the form of some areas of the print media 190 being excessively light, with other areas being excessively dark or smudged.

Method for Consistent Print Contrast

The present system and method provides for a substantially consistent level of print contrast and print quality across the width of print media 190, even when the pressure on print media 190 varies along the width of the print media due to a narrow print media 190.2 which is off-center from printhead 118 and platen 122.

The present system and method compensates for the pressure variations by adjusting the intensity of the applied contrast-inducing element (including for example and without limitation, adjusting the applied heat, applied light, or applied ink or toner) which is applied by the printhead 118. With respect to exemplary thermal printer 100, the method generally entails:

(1) Identifying parts (sections, regions, or areas) of print media 190 subject to an average pressure from printhead 118; parts of print media 190 subject to an above average pressure, and parts subject to a below average pressure.

(2) In an embodiment of the present system and method, the choice of pixel intensities is binary, meaning that a given pixel is either white or black. Each media type will have different intensity/power requirement in order to have a good quality print. For example, a Media/Label of a Type "A" may need an average 45% intensity in order to print black color. Lower power than that may not able to generate a black pixel. During printing, to generate a black pixel, a relatively higher pinhead temperature (for example, 48°) may be applied on parts of the print media subject to below average pressure 230.1; while to generate a black pixel on areas of the print media subject to above average pressure 230.2, the print process may employ a relatively lower pinhead temperature or power (for example, 42%).

In an alternative embodiment, different pixels may have different, designated levels of pixel darkness (for example, white, black, or a designated shade of gray). Alternatively, instead of different shades of darkness, different pixels may be of different sizes (that is, different diameters). Pixels of a designated degree of darkness (or pixel size) may require on average a certain power level, such as for example 40°. Here again, for a given pixel intensity (or size) the present system and may employ a relatively higher pinhead power (for example, 43%) on parts of the print media subject to below average pressure 230.1; similarly, on part of the print media subject to above average pressure, and for the same intended pixel size or intensity, the pinhead power may be reduced (for example, to 37%).

FIG. 3 is a flow chart of an exemplary method 300 to provide for consistent print contrast across the width of print media 190.

Print Media Width Detection:

In exemplary method 300, pressure variation across the width 210 of print media 300 is estimated based on the width of the print media 190 relative to the width 240 of thermal printhead 118 and/or platen 122.

In an embodiment, the method 300 may assume (and base pressure calculations on the assumption) that print media 190 is substantially aligned with a first end or a second end of printhead 118 and/or platen 122 (as illustrated for example in FIG. 2 above). However, in an alternative embodiment (not described in detail below), method 300 may both detect the width 210 of print media 190, and detect a placement of print media 190 along printhead 118 and/or platen 122; method 300 may then further take such placement into account for determining pressure variations.

In step 310 of method 300, printer 100 detects the width 210 of print media 190.

In an embodiment, discussed further below in conjunction with FIG. 5, printer 100 detects the width of print media 190 by illuminating print media 190 with light, and employs a light sensor 510 (see FIG. 5), such as for example and without limitation a linear image sensor, to detect how much light is blocked by print media 190.

In an alternative embodiment, printer 100 detects the width 210 of print media 190 via a mechanical detection element, such as a paper guide (not illustrated in the figures) which is configured to make contact with an edge or edges of print media 190. Such a paper guide may be set by a user of printer 100, or may be set automatically by electromechanical motion and sensing means (not illustrated in the figures).

In an alternative embodiment, printer 100 may detect the width 210 of print media 190 via a symbol, indicia, or other indicator on or in print media 190 itself. For example, print media 190 may have a bar code or matrix code at a feeder (front) end of the media, or may have microscopic bar or matrix codes imprinted on the media. Print media 190 may also have an attached RFID tag or microdot configured with print media information, including at least width 210. Other means for print media 190 to signal, to printer 100, the width 210 of print media 190 may be imagined as well. Printer 100 would have suitable detection apparatus to detect such width insignia.

Estimation of Pressure Variation:

In step 320, hardware processor 107 or control circuits 113 of printer 100 calculate the pressure variation across the width 210 of print media 190 based on the width of print media 190. Various calculations are possible.

In an embodiment, suitable pressure formulas or tables may be based upon laboratory tests of prototypes of printer 100 with various widths of print media 190 during printer design and development.

In an embodiment, a calculation is performed based on the width of the print media. See FIG. 4 below.

In an alternative embodiment, pressure variations across the width 210 of print media 190 may be determined or estimated by other means. (See the discussion below in this document under the heading "Alternative Embodiments.")

Step 330 is diagrammed as two alternative steps, 330.1 which applies for black/white only pixels, or in the alternative, step 330.2 which applies if pixels may be generated which are different shades (white, black, or shades of gray) or different diameters (from a smallest diameter pixel to a maximum size pixel).

In step 330.1, method 300 determines the appropriate heat for a pinhead 120 based on:

(i) the power required to print a black pixel assuming a uniform pressure across the entire width of the print media (the location of the black pixels being determined, in turn, by the intended raster line to be printed); and (ii) the pressure, or pressure variation from the average print pressure, at the pinhead location for a given pixel.

In step 330.2, method 300 determines the appropriate heat for a pinhead 120 based on:

(i) the power required, on average, for an intended, specified print intensity or contrast for the pixel at the pinhead location (which, in turn, is determined by the intended intensity of pixels along the raster line to be printed); and (ii) the pressure, or pressure variation from the average print pressure, at the pinhead location.

Here, the term "pinhead location" refers to a pinhead's distance along the width of print media 190. Pressure variations are associated with various distances along the width of print media 190.

In general, for pinheads 120 which exert a relatively higher than average pressure on print media 190, step 330 establishes a relatively below-average heat for the given pixel intensity. Similarly, for pinheads 120 which exert a relatively higher than average pressure on print media 190, step 330 establishes a relatively above-average heat for the given pixel intensity.

Table 3 pertains to method step 330.2, where various different pixel intensities or sizes may be printed. Table 3 is adapted from Table 2, already discussed above. Table 3 is an exemplary Pinhead Heat Table which provides an exemplary set of temperature adjustments to provide a consistent pixel color for various print pressures. The numbers shown are for purposes of illustration and are exemplary only. Other numbers may apply for particular printers 100 and printheads 118.

TABLE 3

| | Pixel Color (% black) | | | | |
|---|---|---|---|---|---|
| Pin Pressure | White 0% | Light Gray 25% | Medium Gray 50% | Dark Gray 75% | Black 100% |
| 30 kg-Newton | 60° | 70° | 80° | 90° | 100° |
| 35 kg-Newton | 50° | 60° | 70° | 80° | 90° |
| 40 kg-Newton | 40° | 50° | 60° | 70° | 80° |

For example, and as can be seen from Table 3, to achieve a medium gray pixel color (50% black), a pinhead temperature of 80 degrees may be required if the pinhead pressure is at the lowest value of 30 kg-Newton; while to achieve the same medium-gray pixel color (50% black), a pinhead temperature of only 70 degrees may be requires at 35 kg-Newton pinhead pressure, and a temperature of only 60 degrees may be required at the highest pressure 40 kg-Newton pinhead pressure.

Persons skilled in the relevant arts will recognize that for a given intended print intensity, other temperatures may be applied as well depending on the pinhead pressure on print media 190. In the exemplary case shown in Table 3, at a pressure of 32.5 kg-Newtons, for instance, the application of approximately 75 degrees at the pinhead may result in the desired medium gray pixel color (50% black).

Stored Data Table and Interpolation During Printing:

In an embodiment of the present system and method, a Pinhead Heat Table or tables (or other data structure) similar to exemplary Table 3, which correlates media pressure and desired pixel intensity with a designated pin temperature, may be established during printer research, design, and development. Such a table or other data structure may then be stored in static memory 109 of printer 100 or control circuits 113, or otherwise employed during printing by CPU 107.

As per the discussion immediately above, for pixel intensities or paper pressures not specifically stored in the Pinhead Heat Table, intermediate intensities and pressures may be interpolated by CPU 107, and appropriate pin temperatures or pin power may be interpolated as well.

Printing:

In step 340, hardware processor 107 or control circuits 113 of printer 100 causes the pinheads 120 of thermal print element 118 to generate heat at the temperatures calculated in step 330, thereby printing a raster line 210.

Repeating the steps of the method to print multiple raster lines 210 causes thermal printer 100 to print the desired text, graphics or symbols on print media 190, with a consistent print density (for a given desired pixel output) across the width 210 of print media 190.

Other Types of Printers:

Persons skilled in the relevant arts will appreciate that the steps of method 300 can readily be adapted to other types of printers. For example, for an inkjet printer: For step 330, an inkjet printer may calculate, for a given pixel density (white, black, a designated medium gray, etc.) a variation in the amount of ink to output at an ink nozzle, to compensate for variations in the pressure at successive ink nozzles. Similar, suitable adaptations may be envisioned for others kinds of printers as well.

Exemplary Pressure and Heat Calculation

FIG. 4 graphically illustrates an exemplary calculation 400 pertaining to pressure variations across print media 190. In an embodiment, such an exemplary calculation may be employed, for example, in implementations of steps 320 and 330 of method 300 discussed above in conjunction with FIG. 3. Exemplary calculation 400 may be performed by hardware processor 107 or control circuits 113 of printer 100.

Obtaining Width:

In a first stage 410 of the calculations, a MAXIMUM_WIDTH 210 of print media 190 is obtained via various printer hardware, as discussed elsewhere in this document.

It is assumed that the width of the printhead 118 or platen 122 is known from the design of the printer. Such data may be permanently stored in printer 100, for example in static memory 109.

Calculating Pressure Variation Across Width:

In a second stage 420 of the calculations, pressure or pressure variation across the width of the media is calculated, as a function of distance across the width (from zero (0) to a Width of Print Media (WPM)) from stage 410.

Pressure Variations and Media Width:

In an embodiment of the present system and method, the degree or extent of pressure variation across the print media may be inversely correlated with the ratio of (i) the width of the print media 190 and (ii) the width of platen 122 and thermal printhead 118. For example, if the width 210 print media 190 is 70% to 95% of the width 240 of platen 122, the pressure variation from one end of print media 190 to the other may be a relatively small pressure variation. For another example, if the width of print media 190 is only 5% to 30% of the width 240 of platen 122, the pressure variation across the width 210 of media 190 may be a relatively large pressure variation. For intermediate relative widths (for example, 30% to 70%, the pressure variation across the width 210 of media 190 may be moderate.

In an embodiment of the present system and method, pressure variations are determined via lab testing during product research and development. Pressure variations for different media-to-platen width ratios so obtained may then stored in printer 100 in non-volatile memory 109, and may be retrieved by processor 107 as needed during printing.

In an alternative embodiment, pressure variations across media 190 may be determined via calculations made during printing. In an embodiment, the following exemplary detailed calculations and/or data retrievals may be performed:

(i) WPM=Width 210 of print media, (ii) Obtain an Average Pressure (AP) 429 on print media=a known value determined during printer development (or possibly various known values for different media widths 210 or different media types) and stored for example in static memory 109.

(iii) Obtain a known Maximum Possible Pressure Change value (MPPC)=a known value determined during printer development, and stored for example in static memory 109. (This value is not illustrated in FIG. 4.)

$$\text{Calculate the End Point Pressure Variation } (EPPV) \text{ from the } MPPC = MPPC * (1 - \text{Fractional Part of Platen Covered by Print Media}) = MPPC * (1 - (WPM/\text{Platen Width})) \quad \text{(iv)}$$

$$\text{Slope} = 2 * (EPPV/WPM) \quad \text{(v)}$$

(vi) DS=any designated distance along the print media 190 from the print media edge, as determined for example by a choice of a particular heating element 120.

(vii) Pressure on Media (PM)=Average Pressure (AP)+ Fractional Pressure Variation (FP)=Average Pressure (AP)+ [Slope*(DS−WPM/2)]

The above calculations are exemplary only. Other calculations may be performed within the scope and spirit of the present system and method in order to assess the pressure at points along media 190.

Calculate power applied to printhead pins: In a third stage 430 of the calculations, the heat or power applied to printhead pins is calculated for each pinhead 120 of thermal printhead 118. In an embodiment, and for any selected or intended pixel intensity, there may be an linear relationship between the pinhead pressure, the applied heat at the pinhead, and the resulting printed pixel intensity. An exemplary formula may be Formula 1:

$$\alpha*\text{pinhead_pressure}*\text{pinhead_heat}=\text{pixel intensity}$$

where α (alpha) is a constant of proportionality which may be determined during printer development and testing. In such an embodiment, during stage 430 of calculations, and for any selected or intended pixel intensity, an appropriate pinhead heat level may be determined as:

$$\text{pinhead_heat}=\text{pixel_intensity}/(\alpha*\text{pinhead_pressure})=\text{pixel_intensity}/(\alpha*PM(DS))$$

PM, the pressure on the media at a pinhead, may be a linearly dependent function, depending on the linear position DS of the pinhead (see exemplary calculation stage 420, in particular step (vii) above). Persons skilled in the relevant arts will appreciate that at further distances trending from the lower pressure regions to higher pressure regions, the applied pinhead power decreases.

In an embodiment of the present system and method, where the pixels are either white or black, a pixel intensity of white may have a first fixed value, while a pixel intensity may have a second higher fixed value. In such an embodiment, pinhead heat may be determined as:

$$\text{pinhead_heat}=\text{black_pixel_intensity}/(\alpha*PM(DS))$$

Persons skilled in the relevant arts will appreciate that the above formulas are exemplary only. During printer design and development, testing may reveal other suitable formulas or calculations to generate consistent pixel print intensity across the width of print media 190 for any particular, desired pixel intensity; or for printing which entails only black and white pixels.

Such suitable formulas or calculations may be implemented by the present system and method such that, for a given desired pixel intensity, a suitable power may be applied to a pinhead 122 to compensate for pressure variations across media 190. Such suitable formulas or calculations may be calculated by CPU 107 or control circuits 113 of thermal printer 100; and such formulas or computer code based thereon may be stored in static memory 109.

Formulas Suitable for Other Types of Printers:

In an alternative embodiment of the present system and method, formulas may be employed by printer 100 to determine other variations in the intensity of a contrast-inducing media (such as light or inkjet ink), such variations being designed to compensate for variations in the pressure applied on print media 190 by printhead 118.

For example, an inkjet printer may have multiple print nozzles designed to deliver ink across the width of a printhead. Nozzles at points of lower pressure may be designed to deliver more ink according to suitable formulas.

Exemplary Thermal Printer Configured to Compensate for Pressure on Print Media

The present system and method may be applicable to multiple different kinds of printers, including but not limited to thermal printers, LED printers, inkjet printers, laser printers, and other kinds of printers as well. The system and method compensates for pressure variations on print media 190 during the print process. The system and method compensates for the pressure variations by adjusting the intensity of the applied contrast-inducing element (such as heat, light, ink, or toner) by printhead 118.

As discussed above, the present system and method may calculate or estimate pressure variations based on the width of print media 190. In an exemplary embodiment, printer 100 may employ the use of light to determine the width of print media 190.

FIG. 5 illustrates an exemplary width detection system 500, internal to printer 100, which employs light (illumination) to determine width. For context, the figure also illustrates other internal elements of printer 100 which were already discussed above (see especially FIGS. 1 and 2); discussion of those elements is not repeated here.

Exemplary width detection system 500 includes an illumination source 505, which may be a fluorescent bulb, a halogen bulb, an LED or series of adjacent LEDs, a laser source, or other sources of illumination well known in the art. Illumination source 505 is positioned within printer 100 to be substantially parallel to the width of thermal printhead 118 and platen 122. Illumination source 505 is also of substantially the same width as thermal printhead 118 and platen 122. Illumination source 505 is therefore configured to substantially span the width of the widest print media 190 which may be used in printer 100.

Illumination source 505 is positioned so as to be on a first side of the flat surface of any print media 190 which may be present in printer 100 (for example, either one of above print media 190 or below print media 190 when the printer 100 is oriented as it would be in standard use).

Width detection system 500 also includes a light detector 510, for example a linear image sensor 510, which may include a series of adjacent photodetectors 515 positioned along the width of light detector 510. As with illumination source 505, light detector 510 is positioned within printer 100 to be substantially parallel to the width of thermal printhead 118 and platen 122; and so also parallel to illumination source 505.

Light detector 510 is also of substantially the same width as illumination source 505.

Light detector 510 is positioned so as to be on a second side of the flat surface of any print media 190 which may be present in printer 100, and so therefore be on an opposite side from light source 505. For example, if light source 505 is positioned above print media 190, then light detector 510 may be positioned below print media 190.

As a result, width detection system 500 is configured so that when print media 190 is present within printer 100, print media 190 is interposed or "sandwiched" between light source 505 and light detector 510. In consequence, print media 190 will be positioned to block light which emanates from light source 505, so that the light does not reach light detector 510.

If print media 190 is less than the full width of light detector 510, then print media 190 will only block light along its width. FIG. 5 illustrates an exemplary print media 190 (a ribbon of labels) which is less than the full width of exemplary width detection system 500. As such, a first group of light rays 520.1 emanating from light source 505 are not blocked from reaching light detector 510 and its photoreceptors 515. However, a second group of light rays 520.2 are blocked, by print media 190, so that they do not reach light detector 510 and its photoreceptors 515.

Light detector 510 is coupled with hardware microprocessor 107 and/or control circuits 113 via bus 195 or other internal connections. Light detector 510 is configured to send a signal to microprocessor 107 and/or control circuits 113 indicating which photoreceptors 515 receive light 520, and which photoreceptors 515 do not receive light 520.

Microprocessor 107 and/or control circuits 113 can use the photoreceptor data to determine the width 210 of the current print media 190. A maximum possible media width for the printer may be stored, for example, in static memory 109 or in control circuits 113. Also stored in static memory 109 or in control circuits 113 may be the total number of photoreceptors on light detector 510. An exemplary formula for width determination is:

Media_Width=Maximum_Media_Width*Number_Of_Photoreceptors_Which_Receive_Light/Total_Number_Of_Photoreceptors As discussed above, once the media width 210 has been determined, in exemplary embodiments it is possible to determine the pressure variations on print media 190. (See FIGS. 3 and 4 above.)

Alternative Embodiments

In exemplary method 300 above, pressure variations along print media 190 are estimated based on a measurement of the width of print media 190.

In an alternative embodiment, platen 122 may be arranged and configured to have numerous, closely space, small pressure sensors embedded in or distributed along its entire surface. Such pressure sensors may provide direct measurements of the pressure applied to print media 190 at points along the width 210 of print media 190. Such pressure readings may then be used directly as a basis to determine compensatory changes in the heat applied by heating elements 120.

In an alternative embodiment, thermal printhead 118 may be arranged and configured to have small pressure sensors embedded within, for example directly behind heating elements 120. Such pressure sensors may provide direct measurements of the pressure applied to print media 190 at points along the width 210 of print media 190. Such pressure readings may then be used directly as a basis to determine compensatory changes in the heat applied by heating elements 120.

To supplement the present disclosure, this application incorporates entirely by reference the following commonly assigned patents, patent application publications, and patent applications:

U.S. Pat. Nos. 6,832,725; 7,128,266; 7,159,783; 7,413,127; 7,726,575; 8,294,969; 8,317,105; 8,322,622; 8,366,005; 8,371,507; 8,376,233; 8,381,979; 8,390,909; 8,408,464; 8,408,468; 8,408,469; 8,424,768; 8,448,863; 8,457,013; 8,459,557; 8,469,272; 8,474,712; 8,479,992; 8,490,877; 8,517,271; 8,523,076; 8,528,818; 8,544,737; 8,548,242; 8,548,420; 8,550,335; 8,550,354; 8,550,357; 8,556,174; 8,556,176; 8,556,177; 8,559,767; 8,599,957; 8,561,895; 8,561,903; 8,561,905; 8,565,107; 8,571,307; 8,579,200; 8,583,924; 8,584,945; 8,587,595; 8,587,697; 8,588,869; 8,590,789; 8,596,539; 8,596,542; 8,596,543; 8,599,271; 8,599,957; 8,600,158; 8,600,167; 8,602,309; 8,608,053; 8,608,071; 8,611,309; 8,615,487; 8,616,454; 8,621,123; 8,622,303; 8,628,013; 8,628,015; 8,628,016; 8,629,926; 8,630,491; 8,635,309; 8,636,200; 8,636,212; 8,636,215; 8,636,224; 8,638,806; 8,640,958; 8,640,960; 8,643,717; 8,646,692; 8,646,694; 8,657,200; 8,659,397; 8,668,149; 8,678,285; 8,678,286; 8,682,077; 8,687,282; 8,692,927; 8,695,880; 8,698,949; 8,717,494; 8,717,494; 8,720,783; 8,723,804; 8,723,904; 8,727,223; 8,740,082; 8,740,085; 8,746,563; 8,750,445; 8,752,766; 8,756,059; 8,757,495; 8,760,563; 8,763,909; 8,777,108; 8,777,109; 8,779,898; 8,781,520; 8,783,573; 8,789,757; 8,789,758; 8,789,759; 8,794,520; 8,794,522; 8,794,525; 8,794,526; 8,798,367; 8,807,431; 8,807,432; 8,820,630; 8,822,848; 8,824,692; 8,824,696; 8,842,849; 8,844,822; 8,844,823; 8,849,019; 8,851,383; 8,854,633; 8,866,963; 8,868,421; 8,868,519; 8,868,802; 8,868,803; 8,870,074; 8,879,639; 8,880,426; 8,881,983; 8,881,987; 8,903,172; 8,908,995; 8,910,870; 8,910,875; 8,914,290; 8,914,788; 8,915,439; 8,915,444; 8,916,789; 8,918,250; 8,918,564; 8,925,818; 8,939,374; 8,942,480; 8,944,313; 8,944,327; 8,944,332; 8,950,678; 8,967,468; 8,971,346; 8,976,030; 8,976,368; 8,978,981; 8,978,983; 8,978,984; 8,985,456; 8,985,457; 8,985,459; 8,985,461; 8,988,578; 8,988,590; 8,991,704; 8,996,194; 8,996,384; 9,002,641; 9,007,368; 9,010,641; 9,015,513; 9,016,576; 9,022,288; 9,030,964; 9,033,240; 9,033,242; 9,036,054; 9,037,344; 9,038,911; 9,038,915; 9,047,098; 9,047,359; 9,047,420; 9,047,525; 9,047,531; 9,053,055; 9,053,378; 9,053,380; 9,058,526; 9,064,165; 9,064,165; 9,064,167; 9,064,168; 9,064,254; 9,066,032; 9,070,032; 9,076,459; 9,079,423; 9,080,856; 9,082,023; 9,082,031; 9,084,032; 9,087,250; 9,092,681; 9,092,682; 9,092,683; 9,093,141; 9,098,763; 9,104,929; 9,104,934; 9,107,484; 9,111,159; 9,111,166; 9,135,483; 9,137,009; 9,141,839; 9,147,096; 9,148,474; 9,158,000; 9,158,340; 9,158,953; 9,159,059; 9,165,174; 9,171,543; 9,183,425; 9,189,669; 9,195,844; 9,202,458; 9,208,366; 9,208,367; 9,219,836; 9,224,024; 9,224,027; 9,230,140; 9,235,553; 9,239,950; 9,245,492; 9,248,640; 9,250,652; 9,250,712; 9,251,411; 9,258,033; 9,262,633; 9,262,660; 9,262,662; 9,269,036; 9,270,782; 9,274,812; 9,275,388; 9,277,668; 9,280,693; 9,286,496; 9,298,964; 9,301,427; 9,313,377; 9,317,037; 9,319,548; 9,342,723; 9,361,882; 9,365,381; 9,373,018; 9,375,945; 9,378,403; 9,383,848; 9,384,374; 9,390,304; 9,390,596; 9,411,386; 9,412,242; 9,418,269; 9,418,270; 9,465,967; 9,423,318; 9,424,454; 9,436,860; 9,443,123; 9,443,222; 9,454,689; 9,464,885; 9,465,967; 9,478,983; 9,481,186; 9,487,113; 9,488,986; 9,489,782; 9,490,540; 9,491,729; 9,497,092; 9,507,974; 9,519,814; 9,521,331; 9,530,038; 9,572,901; 9,558,386; 9,606,581; 9,646,189; 9,646,191; 9,652,648; 9,652,653; 9,656,487; 9,659,198; 9,680,282; 9,697,401; 9,701,140; U.S. Design Pat. No. D702,237; U.S. Design Pat. No. D716,285; U.S. Design Pat. No. D723,560; U.S. Design Pat. No. D730,357; U.S. Design Pat. No. D730,901; U.S. Design Pat. No. D730,902; U.S. Design Pat. No. D734,339; U.S. Design Pat. No. D737,321; U.S. Design Pat. No. D754,205; U.S. Design Pat. No. D754,206; U.S. Design Pat. No. D757,009; U.S. Design Pat. No. D760,719; U.S. Design Pat. No. D762,604; U.S. Design Pat. No. D766,244; U.S. Design Pat. No. D777,166; U.S. Design Pat. No. D771,631; U.S. Design Pat. No. D783,601; U.S. Design Pat. No. D785,617; U.S. Design Pat. No. D785,636; U.S. Design Pat. No. D790,505; U.S. Design Pat. No. D790,546; International Publication No. 2013/163789; U.S. Patent Application Publication No. 2008/0185432; U.S. Patent Application Publication No. 2009/0134221; U.S. Patent Application Publication No. 2010/0177080; U.S. Patent Application Publication No. 2010/0177076; U.S. Patent Application Publication No. 2010/0177707; U.S.

Patent Application Publication No. 2010/0177749; U.S. Patent Application Publication No. 2010/0265880; U.S. Patent Application Publication No. 2011/0202554; U.S. Patent Application Publication No. 2012/0111946; U.S. Patent Application Publication No. 2012/0168511; U.S. Patent Application Publication No. 2012/0168512; U.S. Patent Application Publication No. 2012/0193423; U.S. Patent Application Publication No. 2012/0194692; U.S. Patent Application Publication No. 2012/0203647; U.S. Patent Application Publication No. 2012/0223141; U.S. Patent Application Publication No. 2012/0228382; U.S. Patent Application Publication No. 2012/0248188; U.S. Patent Application Publication No. 2013/0043312; U.S. Patent Application Publication No. 2013/0082104; U.S. Patent Application Publication No. 2013/0175341; U.S. Patent Application Publication No. 2013/0175343; U.S. Patent Application Publication No. 2013/0257744; U.S. Patent Application Publication No. 2013/0257759; U.S. Patent Application Publication No. 2013/0270346; U.S. Patent Application Publication No. 2013/0292475; U.S. Patent Application Publication No. 2013/0292477; U.S. Patent Application Publication No. 2013/0293539; U.S. Patent Application Publication No. 2013/0293540; U.S. Patent Application Publication No. 2013/0306728; U.S. Patent Application Publication No. 2013/0306731; U.S. Patent Application Publication No. 2013/0307964; U.S. Patent Application Publication No. 2013/0308625; U.S. Patent Application Publication No. 2013/0313324; U.S. Patent Application Publication No. 2013/0332996; U.S. Patent Application Publication No. 2014/0001267; U.S. Patent Application Publication No. 2014/0025584; U.S. Patent Application Publication No. 2014/0034734; U.S. Patent Application Publication No. 2014/0036848; U.S. Patent Application Publication No. 2014/0039693; U.S. Patent Application Publication No. 2014/0049120; U.S. Patent Application Publication No. 2014/0049635; U.S. Patent Application Publication No. 2014/0061306; U.S. Patent Application Publication No. 2014/0063289; U.S. Patent Application Publication No. 2014/0066136; U.S. Patent Application Publication No. 2014/0067692; U.S. Patent Application Publication No. 2014/0070005; U.S. Patent Application Publication No. 2014/0071840; U.S. Patent Application Publication No. 2014/0074746; U.S. Patent Application Publication No. 2014/0076974; U.S. Patent Application Publication No. 2014/0097249; U.S. Patent Application Publication No. 2014/0098792; U.S. Patent Application Publication No. 2014/0100813; U.S. Patent Application Publication No. 2014/0103115; U.S. Patent Application Publication No. 2014/0104413; U.S. Patent Application Publication No. 2014/0104414; U.S. Patent Application Publication No. 2014/0104416; U.S. Patent Application Publication No. 2014/0106725; U.S. Patent Application Publication No. 2014/0108010; U.S. Patent Application Publication No. 2014/0108402; U.S. Patent Application Publication No. 2014/0110485; U.S. Patent Application Publication No. 2014/0125853; U.S. Patent Application Publication No. 2014/0125999; U.S. Patent Application Publication No. 2014/0129378; U.S. Patent Application Publication No. 2014/0131443; U.S. Patent Application Publication No. 2014/0133379; U.S. Patent Application Publication No. 2014/0136208; U.S. Patent Application Publication No. 2014/0140585; U.S. Patent Application Publication No. 2014/0152882; U.S. Patent Application Publication No. 2014/0158770; U.S. Patent Application Publication No. 2014/0159869; U.S. Patent Application Publication No. 2014/0166759; U.S. Patent Application Publication No. 2014/0168787; U.S. Patent Application Publication No. 2014/0175165; U.S. Patent Application Publication No. 2014/0191684; U.S. Patent Application Publication No. 2014/0191913; U.S. Patent Application Publication No. 2014/0197304; U.S. Patent Application Publication No. 2014/0214631; U.S. Patent Application Publication No. 2014/0217166; U.S. Patent Application Publication No. 2014/0231500; U.S. Patent Application Publication No. 2014/0247315; U.S. Patent Application Publication No. 2014/0263493; U.S. Patent Application Publication No. 2014/0263645; U.S. Patent Application Publication No. 2014/0270196; U.S. Patent Application Publication No. 2014/0270229; U.S. Patent Application Publication No. 2014/0278387; U.S. Patent Application Publication No. 2014/0288933; U.S. Patent Application Publication No. 2014/0297058; U.S. Patent Application Publication No. 2014/0299665; U.S. Patent Application Publication No. 2014/0332590; U.S. Patent Application Publication No. 2014/0351317; U.S. Patent Application Publication No. 2014/0362184; U.S. Patent Application Publication No. 2014/0363015; U.S. Patent Application Publication No. 2014/0369511; U.S. Patent Application Publication No. 2014/0374483; U.S. Patent Application Publication No. 2014/0374485; U.S. Patent Application Publication No. 2015/0001301; U.S. Patent Application Publication No. 2015/0001304; U.S. Patent Application Publication No. 2015/0009338; U.S. Patent Application Publication No. 2015/0014416; U.S. Patent Application Publication No. 2015/0021397; U.S. Patent Application Publication No. 2015/0028104; U.S. Patent Application Publication No. 2015/0029002; U.S. Patent Application Publication No. 2015/0032709; U.S. Patent Application Publication No. 2015/0039309; U.S. Patent Application Publication No. 2015/0039878; U.S. Patent Application Publication No. 2015/0040378; U.S. Patent Application Publication No. 2015/0049347; U.S. Patent Application Publication No. 2015/0051992; U.S. Patent Application Publication No. 2015/0053769; U.S. Patent Application Publication No. 2015/0062366; U.S. Patent Application Publication No. 2015/0063215; U.S. Patent Application Publication No. 2015/0088522; U.S. Patent Application Publication No. 2015/0096872; U.S. Patent Application Publication No. 2015/0100196; U.S. Patent Application Publication No. 2015/0102109; U.S. Patent Application Publication No. 2015/0115035; U.S. Patent Application Publication No. 2015/0127791; U.S. Patent Application Publication No. 2015/0128116; U.S. Patent Application Publication No. 2015/0133047; U.S. Patent Application Publication No. 2015/0134470; U.S. Patent Application Publication No. 2015/0136851; U.S. Patent Application Publication No. 2015/0142492; U.S. Patent Application Publication No. 2015/0144692; U.S. Patent Application Publication No. 2015/0144698; U.S. Patent Application Publication No. 2015/0149946; U.S. Patent Application Publication No. 2015/0161429; U.S. Patent Application Publication No. 2015/0178523; U.S. Patent Application Publication No. 2015/0178537; U.S. Patent Application Publication No. 2015/0178685; U.S. Patent Application Publication No. 2015/0181109; U.S. Patent Application Publication No. 2015/0199957; U.S. Patent Application Publication No. 2015/0210199; U.S. Patent Application Publication No. 2015/0212565; U.S. Patent Application Publication No. 2015/0213647; U.S. Patent Application Publication No. 2015/0220753; U.S. Patent Application Publication No. 2015/0220901; U.S. Patent Application Publication No. 2015/0227189; U.S. Patent Application Publication No. 2015/0236984; U.S. Patent Application Publication No. 2015/0239348; U.S. Patent Application Publication No. 2015/0242658; U.S. Patent
Application Publication No. 2015/0248572; U.S. Patent
Application Publication No. 2015/0254485; U.S. Patent
Application Publication No. 2015/0261643; U.S. Patent
Application Publication No. 2015/0264624; U.S. Patent
Application Publication No. 2015/0268971; U.S. Patent
Application Publication No. 2015/0269402; U.S. Patent
Application Publication No. 2015/0288689; U.S. Patent
Application Publication No. 2015/0288896; U.S. Patent
Application Publication No. 2015/0310243; U.S. Patent
Application Publication No. 2015/0310244; U.S. Patent
Application Publication No. 2015/0310389; U.S. Patent
Application Publication No. 2015/0312780; U.S. Patent
Application Publication No. 2015/0327012; U.S. Patent
Application Publication No. 2016/0014251; U.S. Patent
Application Publication No. 2016/0025697; U.S. Patent
Application Publication No. 2016/0026838; U.S. Patent
Application Publication No. 2016/0026839; U.S. Patent
Application Publication No. 2016/0040982; U.S. Patent
Application Publication No. 2016/0042241; U.S. Patent
Application Publication No. 2016/0057230; U.S. Patent
Application Publication No. 2016/0062473; U.S. Patent
Application Publication No. 2016/0070944; U.S. Patent
Application Publication No. 2016/0092805; U.S. Patent
Application Publication No. 2016/0101936; U.S. Patent
Application Publication No. 2016/0104019; U.S. Patent
Application Publication No. 2016/0104274; U.S. Patent
Application Publication No. 2016/0109219; U.S. Patent
Application Publication No. 2016/0109220; U.S. Patent
Application Publication No. 2016/0109224; U.S. Patent
Application Publication No. 2016/0112631; U.S. Patent
Application Publication No. 2016/0112643; U.S. Patent
Application Publication No. 2016/0117627; U.S. Patent
Application Publication No. 2016/0124516; U.S. Patent
Application Publication No. 2016/0125217; U.S. Patent
Application Publication No. 2016/0125342; U.S. Patent
Application Publication No. 2016/0125873; U.S. Patent
Application Publication No. 2016/0133253; U.S. Patent
Application Publication No. 2016/0171597; U.S. Patent
Application Publication No. 2016/0171666; U.S. Patent
Application Publication No. 2016/0171720; U.S. Patent
Application Publication No. 2016/0171775; U.S. Patent
Application Publication No. 2016/0171777; U.S. Patent
Application Publication No. 2016/0174674; U.S. Patent
Application Publication No. 2016/0178479; U.S. Patent
Application Publication No. 2016/0178685; U.S. Patent
Application Publication No. 2016/0178707; U.S. Patent
Application Publication No. 2016/0179132; U.S. Patent
Application Publication No. 2016/0179143; U.S. Patent
Application Publication No. 2016/0179368; U.S. Patent
Application Publication No. 2016/0179378; U.S. Patent
Application Publication No. 2016/0180130; U.S. Patent
Application Publication No. 2016/0180133; U.S. Patent
Application Publication No. 2016/0180136; U.S. Patent
Application Publication No. 2016/0180594; U.S. Patent
Application Publication No. 2016/0180663; U.S. Patent
Application Publication No. 2016/0180678; U.S. Patent
Application Publication No. 2016/0180713; U.S. Patent
Application Publication No. 2016/0185136; U.S. Patent
Application Publication No. 2016/0185291; U.S. Patent
Application Publication No. 2016/0186926; U.S. Patent
Application Publication No. 2016/0188861; U.S. Patent
Application Publication No. 2016/0188939; U.S. Patent
Application Publication No. 2016/0188940; U.S. Patent
Application Publication No. 2016/0188941; U.S. Patent
Application Publication No. 2016/0188942; U.S. Patent
Application Publication No. 2016/0188943; U.S. Patent
Application Publication No. 2016/0188944; U.S. Patent
Application Publication No. 2016/0189076; U.S. Patent
Application Publication No. 2016/0189087; U.S. Patent
Application Publication No. 2016/0189088; U.S. Patent
Application Publication No. 2016/0189092; U.S. Patent
Application Publication No. 2016/0189284; U.S. Patent
Application Publication No. 2016/0189288; U.S. Patent
Application Publication No. 2016/0189366; U.S. Patent
Application Publication No. 2016/0189443; U.S. Patent
Application Publication No. 2016/0189447; U.S. Patent
Application Publication No. 2016/0189489; U.S. Patent
Application Publication No. 2016/0192051; U.S. Patent
Application Publication No. 2016/0202951; U.S. Patent
Application Publication No. 2016/0202958; U.S. Patent
Application Publication No. 2016/0202959; U.S. Patent
Application Publication No. 2016/0203021; U.S. Patent
Application Publication No. 2016/0203429; U.S. Patent
Application Publication No. 2016/0203797; U.S. Patent
Application Publication No. 2016/0203820; U.S. Patent
Application Publication No. 2016/0204623; U.S. Patent
Application Publication No. 2016/0204636; U.S. Patent
Application Publication No. 2016/0204638; U.S. Patent
Application Publication No. 2016/0227912; U.S. Patent
Application Publication No. 2016/0232891; U.S. Patent
Application Publication No. 2016/0292477; U.S. Patent
Application Publication No. 2016/0294779; U.S. Patent
Application Publication No. 2016/0306769; U.S. Patent
Application Publication No. 2016/0314276; U.S. Patent
Application Publication No. 2016/0314294; U.S. Patent
Application Publication No. 2016/0316190; U.S. Patent
Application Publication No. 2016/0323310; U.S. Patent
Application Publication No. 2016/0325677; U.S. Patent
Application Publication No. 2016/0327614; U.S. Patent
Application Publication No. 2016/0327930; U.S. Patent
Application Publication No. 2016/0328762; U.S. Patent
Application Publication No. 2016/0330218; U.S. Patent
Application Publication No. 2016/0343163; U.S. Patent
Application Publication No. 2016/0343176; U.S. Patent
Application Publication No. 2016/0364914; U.S. Patent
Application Publication No. 2016/0370220; U.S. Patent
Application Publication No. 2016/0372282; U.S. Patent
Application Publication No. 2016/0373847; U.S. Patent
Application Publication No. 2016/0377414; U.S. Patent
Application Publication No. 2016/0377417; U.S. Patent
Application Publication No. 2017/0010141; U.S. Patent
Application Publication No. 2017/0010328; U.S. Patent
Application Publication No. 2017/0010780; U.S. Patent
Application Publication No. 2017/0016714; U.S. Patent
Application Publication No. 2017/0018094; U.S. Patent
Application Publication No. 2017/0046603; U.S. Patent
Application Publication No. 2017/0047864; U.S. Patent
Application Publication No. 2017/0053146; U.S. Patent
Application Publication No. 2017/0053147; U.S. Patent
Application Publication No. 2017/0053647; U.S. Patent
Application Publication No. 2017/0055606; U.S. Patent
Application Publication No. 2017/0060316; U.S. Patent
Application Publication No. 2017/0061961; U.S. Patent
Application Publication No. 2017/0064634; U.S. Patent
Application Publication No. 2017/0083730; U.S. Patent
Application Publication No. 2017/0091502; U.S. Patent
Application Publication No. 2017/0091706; U.S. Patent
Application Publication No. 2017/0091741; U.S. Patent
Application Publication No. 2017/0091904; U.S. Patent
Application Publication No. 2017/0092908; U.S. Patent
Application Publication No. 2017/0094238; U.S. Patent
Application Publication No. 2017/0098947; U.S. Patent
Application Publication No. 2017/0100949; U.S. Patent Application Publication No. 2017/0108838; U.S. Patent Application Publication No. 2017/0108895; U.S. Patent Application Publication No. 2017/0118355; U.S. Patent Application Publication No. 2017/0123598; U.S. Patent Application Publication No. 2017/0124369; U.S. Patent Application Publication No. 2017/0124396; U.S. Patent Application Publication No. 2017/0124687; U.S. Patent Application Publication No. 2017/0126873; U.S. Patent Application Publication No. 2017/0126904; U.S. Patent Application Publication No. 2017/0139012; U.S. Patent Application Publication No. 2017/0140329; U.S. Patent Application Publication No. 2017/0140731; U.S. Patent Application Publication No. 2017/0147847; U.S. Patent Application Publication No. 2017/0150124; U.S. Patent Application Publication No. 2017/0169198; U.S. Patent Application Publication No. 2017/0171035; U.S. Patent Application Publication No. 2017/0171703; U.S. Patent Application Publication No. 2017/0171803; U.S. Patent Application Publication No. 2017/0180359; U.S. Patent Application Publication No. 2017/0180577; U.S. Patent Application Publication No. 2017/0181299; U.S. Patent Application Publication No. 2017/0190192; U.S. Patent Application Publication No. 2017/0193432; U.S. Patent Application Publication No. 2017/0193461; U.S. Patent Application Publication No. 2017/0193727; U.S. Patent Application Publication No. 2017/0199266; U.S. Patent Application Publication No. 2017/0200108; and U.S. Patent Application Publication No. 2017/0200275.

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

In the description above, a flow charted technique may be described in a series of sequential actions. Unless expressly stated to the contrary, the sequence of the actions and the party performing the actions may be freely changed without departing from the scope of the teachings. Actions may be added, deleted, or altered in several ways. Similarly, the actions may be re-ordered or looped. Further, although processes, methods, algorithms or the like may be described in a sequential order, such processes, methods, algorithms, or any combination thereof may be operable to be performed in alternative orders. Further, some actions within a process, method, or algorithm may be performed simultaneously during at least a point in time (e.g., actions performed in parallel), can also be performed in whole, in part, or any combination thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following:

A is true (or present) and B is false (or not present), A is false (or not present) and B is true (or present), and both A and 8 are true (or present).

What is claimed is:

1. A method for printing, comprising:

obtaining a width of a media that is between a thermal printhead of a thermal printer and a platen of the thermal printer;

determining, based on the width of the media, a variation of a pressure of the thermal printhead across the width of the media during the printing; and during printing, setting a heat generated at the thermal printhead, based on the determined variation of the pressure, to compensate for the variation of the pressure of the thermal printhead across the width of the media, wherein setting the heat generated at the thermal printhead to compensate for the variation of the pressure comprises:

applying a first heat at a first heating element of the thermal printhead based on a determined first pressure on the media, wherein the first heat is greater than a standard heat and the determined first pressure is lower than a standard pressure; and applying a second heat at a second heating element of the thermal printhead based on a determined second pressure on the media, wherein the second heat is lower than the standard heat and the determined second pressure is higher than the standard pressure.

2. The method of claim 1, further comprising:

varying between a plurality of heating elements at different positions along the width of the thermal printhead, an intensity of the heat generated at each of the plurality of heating elements, wherein the varying of the heat generated is configured to compensate for the variation of the pressure of the thermal printhead across the width of the media; and the varying of the heat generated, in combination with the variation of the pressure, results in a substantially consistent print intensity at each of the plurality of heating elements.

3. The method of claim 1, wherein obtaining the width of the media further comprises:

illuminating the media by an illumination source;

detecting a portion of illumination received by an illumination sensor; and determining a portion of illumination not received by the illumination sensor due to an interposition of the media between the illumination source and the illumination sensor.

4. The method of claim 1, wherein obtaining the width of the media comprises: measuring the width of the media via a mechanical paper guide.

5. The method of claim 1, wherein obtaining the width of the media comprises:

determining the width of the media from a width indicia, wherein the media comprises the width indicia.

6. The method of claim 1, wherein setting the heat generated at the thermal printhead is based on at least one of:

a printing heat required to print a pixel on the media when the pressure on the media is at a standard pressure, and a determined variation in the pressure at a heating element as compared to the standard pressure.

7. The method of claim 1, wherein each of the thermal printhead and the platen comprises a width which is equal to or greater than the width of the media, wherein the thermal printhead is configured to apply pressure to the media and to the platen during a process of thermal printing on the media, and wherein the media is substantially aligned with a common end of the thermal printhead and the platen.

8. A printer comprising:
a thermal printhead;
a platen;
a memory storing executable instructions thereon; and
a processor configured to execute the instructions to:
obtain a value of a width of a media between the thermal printhead and the platen;
determine, based on the width of the media, an amount of variation of a pressure of the thermal printhead across the width of the media during printing; and
set, during printing, a heat generated at the thermal printhead, based on the determined variation of the pressure, to compensate for the amount of variation of the applied pressure of the thermal printhead across the width of the media, wherein to set the heat generated at the thermal printhead to compensate for the amount of variation of the applied pressure, the processor is further configured to execute the instructions to:
apply a first heat at a first heating element of the thermal printhead based on a determined first pressure on the media, wherein the first heat is greater than a standard heat and the determined first pressure is lower than a standard pressure; and
apply a second heat at a second heating element of the thermal printhead based on a determined second pressure on the media, wherein the second heat is lower than the standard heat and the determined second pressure is higher than the standard pressure.

9. The printer of claim 8, wherein the processor is further configured to execute the instructions to vary, between a plurality of heating elements at different positions along the width of the thermal printhead, an intensity of the heat generated at each of the plurality of heating elements to compensate for the variation of the pressure of the thermal printhead across the width of the media.

10. The printer of claim 8, further comprising:
an illumination source configured to illuminate the media, and
an illumination sensor configured to receive a first portion of illumination reflected off the media,
wherein the processor is further configured to execute the instructions to determine a second portion of illumination not received by the illumination sensor due to an interposition of the media between the illumination source and the illumination sensor.

11. The printer of claim 8, further comprising a mechanical paper guide configured to measure the width of the media.

12. The printer of claim 8, wherein the processor is further configured to execute the instructions to determine the width of the media from a width indicia, wherein the media comprises the width indicia.

13. The printer of claim 8, wherein the processor is further configured to execute the instructions to set the heat generated at the thermal printhead based on at least:
a printing heat required to print a pixel on the media when the pressure on the media is at a standard pressure, and
a determined variation in the pressure at a heating element as compared to the standard pressure.

14. The printer of claim 8, wherein the processor is further configured to execute the instructions to vary the applied pressure on the media across the width of the media, when the width of the media is substantially less than any one of the width of the platen and the width of the thermal printhead, and the media is substantially aligned with a common end of the thermal printhead and the platen.

15. A computer program product comprising at least one computer-readable non-transitory memory medium having program code instructions stored thereon, the program code instructions, when executed by an apparatus comprising at least one processor, cause the apparatus to:
identify a media between a thermal printhead and a platen, obtain a value of a width of the media;
determine, based on the width of the media, an amount of variation of a pressure of the thermal printhead across the width of the media during the printing; and
set, during the printing, a heat generated at the thermal printhead, based on the determined variation of the pressure, to compensate for the amount of variation of the applied pressure of the thermal printhead across the width of the media, wherein to set the heat generated at the thermal printhead to compensate for the amount of variation of the pressure, the program code instructions, when executed by the apparatus, further causes the apparatus to:
apply a first heat at a first heating element of the thermal printhead based on a determined first pressure on the media, wherein the first heat is greater than a standard heat and the determined first pressure is lower than a standard pressure; and
apply a second heat at a second heating element of the thermal printhead based on a determined second pressure on the media, wherein the second heat is lower than the standard heat and the determined second pressure is higher than the standard pressure.

16. The computer program product of claim 15, wherein the program code instructions, when executed by the apparatus, further causes the apparatus to:
vary between a plurality of heating elements at different positions along the width of the thermal printhead, an intensity of the heat generated at each of the plurality of heating elements, to compensate for the variation of the pressure of the thermal printhead across the width of the media, and wherein the variation of the intensity of the heat, in combination with the variation of the pressure, results in a substantially consistent print intensity at each of the plurality of heating elements.

17. The computer program product of claim 15, wherein the program code instructions, when executed by the apparatus, further causes the apparatus to:
set the heat generated at the thermal printhead based on at least a printing heat required to print a pixel on the media when the pressure on the media is at a standard pressure, and
a determined variation in the pressure at a heating element as compared to the standard pressure.

* * * * *